US006132921A

United States Patent [19]

Ishiyama et al.

[11] Patent Number: 6,132,921

[45] Date of Patent: Oct. 17, 2000

[54] TONER FOR ELECTROSTATIC-CHARGED IMAGE DEVELOPER AND PRODUCTION METHOD THEREOF, ELECTROSTATIC-CHARGED IMAGE DEVELOPER, AND IMAGE-FORMING PROCESS

[75] Inventors: Takao Ishiyama; Manabu Serizawa; Takeshi Shoji; Yukiko Watanabe; Yasuo Matsumura, all of Minamiashigara, Japan

[73] Assignee: Fuji Xerox Co., Ltd, Tokyo, Japan

[21] Appl. No.: 09/516,555

[22] Filed: Feb. 29, 2000

[30] Foreign Application Priority Data

Mar. 4, 1999 [JP] Japan ..... 11-056785

[51] Int. Cl.[7] ..... G03G 9/097; G03G 9/087

[52] U.S. Cl. ..... 430/110; 430/111; 430/126; 430/137

[58] Field of Search ..... 430/110, 111, 430/126, 137

[56] References Cited

U.S. PATENT DOCUMENTS

| | | | |
|---|---|---|---|
| 5,578,408 | 11/1996 | Kohtaki et al. | 430/111 |
| 5,707,771 | 1/1998 | Matsunaga | 430/110 |
| 5,817,443 | 10/1998 | Matsushima et al. | 430/111 |
| 5,851,714 | 12/1998 | Taya et al. | 430/111 |
| 5,968,701 | 10/1999 | Onuma et al. | 430/111 |

FOREIGN PATENT DOCUMENTS

| | | |
|---|---|---|
| 59-218459 | 12/1984 | Japan . |
| 59-218460 | 12/1984 | Japan . |
| 63-282750 | 11/1988 | Japan . |
| 2-105163 | 4/1990 | Japan . |
| 4-69666 | 3/1992 | Japan . |
| 4-188156 | 7/1992 | Japan . |
| 5-61239 | 4/1993 | Japan . |
| 6-250439 | 9/1994 | Japan . |
| 9-258481 | 10/1997 | Japan . |

*Primary Examiner*—Roland Martin
*Attorney, Agent, or Firm*—Oliff & Berridge, PLC

[57] ABSTRACT

An electrostatic-charged image developing toner containing a binder resin and a coloring agent, which is excellent in the fixing characteristics, has high charging uniformity and stability, and gives excellent images, wherein the crosslinking molecular weight Mc of the toner obtained by a temperature dispersion measurement in the dynamic viscoelasticity of the toner is from about $1.6\times10^4$ to $3.5\times10^6$, or the crosslinking density Me thereof is from about $1.6\times10^{-8}$ to $3.5\times10^{-6}$/Kmol.

20 Claims, No Drawings

TONER FOR ELECTROSTATIC-CHARGED IMAGE DEVELOPER AND PRODUCTION METHOD THEREOF, ELECTROSTATIC-CHARGED IMAGE DEVELOPER, AND IMAGE-FORMING PROCESS

BACKGROUND OF THE INVENTION

1. Field of the Invention

The present invention relates to a toner for electrostatic-charged image developer used for developing electrostatic latent images formed by an electrophotographic process, electrostatic recording process, etc., the production method of the toner, an electrostatic-charged image developer, and an image-forming process.

2. Background Art

A process of visualizing an image information through electrostatic latent images, such as an electrophotographic process, etc., are utilized in various fields at present. In an electrophotographic process, an electrostatic-charged image (a latent electrostatic image) is formed on a photoreceptor by electrostatic charging and light-exposure steps, the electrostatic latent image is developed by a developer containing a toner and visualized through a transfer step and a fixing step.

As the developer used in this case, a two-component developer composed of a toner and a carrier and a one-component developer using a magnetic toner or a non-magnetic toner singly are known.

For producing these toners, a knead-grinding production method of melt-kneading a thermoplastic resin together with a pigment, an electrostatic charge controlling agent, and a surface lubricant such as a wax, etc., and after cooling, finely grinding and classifying the kneaded mixture is usually used. If necessary, inorganic or organic fine particles are sometimes added to the surfaces of the toner particles for the purpose of improving the fluidity of the developer and the cleaning property. These methods can produce a considerably excellent toner but have the following problems.

That is, in an ordinary knead-grinding production method, the form of the toner and the surface structure of the toner formed are irregular, they are finely changed by the grinding property of the using material and the condition of the grinding step, and it is difficult to positively control the form and the surface structure of the toner formed. Also, in the knead-grinding method, there is a restriction in the range of selecting the material. Practically, the dispersed product of a resin and a colorant is sufficiently brittle and must be finely ground by a production apparatus capable of being used economically.

However, when the dispersed product of a resin and a colorant is brittle, it sometime happen that a fine powder is generated and also the form of the toner is changed by a mechanical shear in a developing apparatus, etc. As the result thereof, in a two-component developer, the fine powder is fixed to the surface of the carrier to accelerate the deterioration of the charging property of the developer, and in a one-component developer, the particle size distribution is enlarged to cause scattering of the toner and, by lowering of the developing property caused by the change of the toner form, the deterioration of the image quality is liable to occur.

Also, in the toner to which a large amount of a lubricant is internally added, according to the combination of a thermal plastic resin, exposing of the lubricant onto the surface of toner is frequently influenced. Particularly, in the combination of a resin which is a little hard to be ground because of the increase in the elasticity by a high molecule weight component and a brittle wax such as polyethylene, many polyethylene is exposed on the surface of the toner. This is advantageous for the lubricating property at fixing and cleaning of the untransferred toner, but polyethylene on the surface layer is easily shifted by a mechanical force to liable to stain a developing roll, a photoreceptor, and a carrier, which results in lowering the reliability of the developer.

Furthermore, when the form of the toner becomes irregular, even by adding a fluidity aid, the fluidity of the toner cannot be sufficiently ensured, and during using the developer, fine particles on the toner surface transfer to the concave portions of the toner by a mechanical shearing force to lower the fluidity of the toner with time, and also the fluidity aid causes embedment in the inside of the toner to reduce the developing property, the transferring property, and the cleaning property of the toner. Also, when the toner recovered by cleaning is returned into the developing apparatus and reused, the image quality is liable to further lower. To prevent the occurrence of these problems, when the amount of the fluidity aid is more increased, the problems that black points form on the photoreceptor and the particles of the fluidity aid are scattered, etc., occur.

Recently, as a method of positively controlling the form and the surface construction of a toner, a production method of a toner by an emulsion polymerization aggregation method is proposed in Japanese Patent Laid-Open Nos. S63-282750 and H06-250439. In these methods, a dispersion of resin fine particles are generally prepared by an emulsion polymerization, on the other hand, a dispersion of a colorant formed by dispersing a colorant in solvent is prepared, both dispersions are mixed to form aggregated particles corresponding to the toner particle sizes, and by heating them, they are melted and coalesced to product a toner. According to the method, the toner form can be controlled to some extent and the charging property and the durability can be improved, but it is difficult to control the particle sizes of the lubricant and the colorant in the toner and the positions of the particles. As a result, there sometimes leave problems in the releasing property of a fixing sheet at fixing and the transparency of an OHP output image.

As described above, in the electrophotographic process, in order that a toner stably keeps the characteristics even under various mechanical stresses, it is necessary that by restraining the exposure of the lubricant onto the toner surface and by increasing the surface hardness without reducing the fixing property, the mechanical strength of the toner itself is improved and the sufficient charging property and the fixing property are compatible with each other.

Recently, the requirement of obtaining a high-quality image is increased and particular, in a color image formation, the tendency of small sizing becomes remarkable for realizing highly precise images. However, in a method of simple small sizing of a toner with the particle size distribution in prior art, by the existence of the toner of a fine powder side, the problems of staining the carrier and the photoreceptor and scattering of the toner become severe and it is difficult to simultaneously realize a high-quality image and a high reliability. For solving the problems, it becomes important to form a sharp particle distribution and make small-sizing of the particle sizes.

Also, in a digital full color copying machine or printer, after color-separating a color image original by each filer of B (blue), R (red) and G (green), a latent electrostatic image made of dots having sizes of from 20 to 70 $\mu$m corresponding to the original is developed by utilizing a subtractive process using each developer of Y (yellow), M (magenta), C (cyan), and Bk (black). Because, as compared with a black and white copying machine, in a digital full color copying machine, etc., it is necessary to transfer large amounts of developers and also it is necessary to correspond to dots having a small size, the uniform charging property, the durability, the toner strength, and the sharpness of the particle size distribution become more and more important. Also, for meeting the high copying speed of the copying machines, etc., and energy saving, etc., a lower temperature fixing property becomes necessary. By considering these points, the toner produced by an aggregation.melt coalescent method suitable for producing small-sized particles having a sharp particle size distribution has excellent characteristics.

In a full color copying or recording machine, it is necessary to sufficiently mix color toners and in this case, the improvement of the color reproducibility and the transparency of OHP images become indispensable.

In general, as a lubricant component, a polyolefin-based wax is added in the toner by internal addition for the purpose of preventing the occurrence of a low-temperature offset at fixing. Also, together with this, a very small amount of a silicone oil is uniformly coated on fixing rollers to improve a high-temperature offset property. Thus, there are problems that the silicone oil adhere to a transfer material to cause a sticky unpleasant feeling, etc.

Thus, in Japanese Patent Laid-Open No. H05-61239, a toner for oilless fixing of incorporating a large amount of a lubricant component in the toner without coating an oil on fixing rolls is provided. However, when a large amount of a lubricant component is added into the toner, the releasing property can be improved to some extent, but a binder resin component becomes compatible with the lubricant and oozing of the lubricant becomes ununiform, whereby the stability of releasing is hard to obtain. Also, the liberated component of the lubricant sometimes causes the hindrance of electrostatic charging.

Also, the dispersibility of a colorant in a color toner causes an interaction with the lubricant to form the aggregate of the colorant, which causes the problems of reducing the transparency of OHP images, the hindrance of coloring, etc.

Thus, for solving these problems, in Japanese Patent Laid-Open No. H02-105163, it is proposed to improve the involving property and the oozing property of the lubricant by positively introducing a resin having a polar group. However, in the method, the oozing property of the lubricant can be improved to some extent and the involving property thereof can be improved, but the method scarcely has the effects of controlling the position of the lubricant in the toner and improving the dispersibility of a pigment in the toner, and the overall fixing properties such as the releasing property, the sticking property of the fixed image, the transparency of OHP images, the bending strength of the fixed image, etc., cannot be improved. Also, the insufficient dispersing property of the colorant, etc., gives large influences on the electrostatic charging faculty.

Also, in Japanese Patent Laid-Open No. H04-188156, it is proposed to use a colorant previously subjected to a surface treatment with a monomer component of a binder resin, a wax component, etc., for improving the dispersibility of the colorant. In the method, the dispersibility of the colorant is improved to some extent but the wax holds the colorant particles therein and thus the colorant particles are aggregated with each other without controlling the dispersibility of the pigment in the inside of the toner, whereby it is difficult to simultaneously satisfy the releasing stability of the fixing sheet and the transparency of OHP images.

Also, to improve the aggregating force of a binder resin for the purpose of improving the releasing property of a fixing sheet, a method of adding a crosslinking agent component to the binder resin is proposed in Japanese Patent Laid-Open Nos. S59-218459 and S59-218460. However, when a crosslinking agent component is simply added to a binder resin, the aggregating force of the binder resin is improved and the releasing property is also improved, but because the rigidity of the binder resin itself is increased, the bending resistance of the fixed image becomes poor. The reduction of the bending resistance of a fixed image causes an image defect at bending the fixed image on paper and greatly lowers the image quality of the output images, the bending strength is an important property for practical use. Furthermore, when the melt viscosity of a binder resin is increased, the smoothness of the surface of the fixed image is reduced, the gloss of the fixed image and the transparency of OHP images are lowered and, in a full color image, a sufficient color mixing property becomes hard to obtain.

Furthermore, in Japanese Patent Laid-Open Nos. H04-69666 and H09-258481, a method of improving the apparent aggregating force of a binder resin by adding a high molecular weight component to the binder resin is proposed.

In these methods, the flexibility of the fixed image itself is improved to some extent but it is difficult to control the crosslinking (entangling) density of the binder resin and the crosslinking molecular weight and it is difficult to simultaneously obtain stably the releasing property and the transparency of OHP images while maintaining the bending resistance of the fixed image.

SUMMARY OF THE INVENTION

Thus, the present invention has been made for solving the problems described above and provides an electrostatic-charged image developing toner excellent in the fixing characteristics such as the releasing property of a fixing sheet, the transparency of OHP images formed, the hot offset resistance, the sticking property of the fixed image, the bending resistance of the fixed image, etc., having a high charging uniformity and stability, causing none of fog, scattering of the toner, etc., and excellent in the image quality of images formed.

The present invention has been succeeded in solving the above-described problems by employing the following constructions.

That is, according to an aspect of the invention, there is provided an electrostatic-charged image developing toner, wherein the crosslinking molecular weight Mc obtained by a temperature dispersion measurement in the dynamic viscoelasticity of the toner is from about $1.6\times10^4$ to $3.5\times10^6$.

According to another aspect of the invention, there is provided the electrostatic-charged image developing toner, wherein the crosslinking density Me obtained by a temperature dispersion measurement in the dynamic viscoelasticity of the toner is from about $1.6\times10^{-8}$ to $3.5\times10^{-6}$/Kmol.

According to another aspect of the invention, there is provided the electrostatic-charged image developing toner, wherein the toner contains in the binder resin a crosslinking agent represented by following formula;

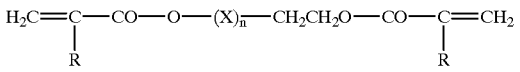

wherein X represents $CH_2$ or $CH_2CH_2O$, n represents an integer of from 4 to 14, and R represents a hydrogen atom or $CH_3$.

According to another aspect of the invention, there is provided the electrostatic-charged image developing toner, wherein the addition amount of the crosslinking agent is in the range of from about 0.1 to 1.5% by weight based on the binder resin.

According to another aspect of the invention, there is provided the electrostatic-charged image developing toner, wherein the glass transition temperature (Tg) of the toner is in the range of from about 50 to 65° C.

According to another aspect of the invention, there is provided the electrostatic-charged image developing toner, wherein a volume mean particle size distribution index GSDv of the toner is not more than about 1.30 and the ratio of the GSDv to a number mean particle size index GSDp is at least about 0.95.

According to another aspect of the invention, there is provided the electrostatic-charged image developing toner, wherein the content of the lubricant dispersed in the toner is in the range of from about 5 to 25% by weight in terms of solid content.

According to another aspect of the invention, there is provided the electrostatic-charged image developing toner, wherein the central diameter of the lubricant particles dispersed in the toner is in the range of from about 150 to 1500 nm measured by a transmission type electron microscope (TEM) According to another aspect of the invention, there is provided the electrostatic-charged image developing toner, wherein the content of a colorant dispersed in the toner is in the range of from about 4 to 15% by weight in terms of solid content.

According to another aspect of the invention, there is provided the electrostatic-charged image developing toner, wherein the central diameter of the colorant particles dispersed in the toner is in the range of from about 100 to 330 nm as measured by a transmission electron microscope (TEM).

According to another aspect of the invention, there is provided the electrostatic-charged image developing toner, wherein the shape factor SF1 of the toner is in the range of from about 110 to 145.

According to another aspect of the invention, there is provided the electrostatic-charged image developing toner, wherein a cumulative volume mean particle size $D_{50}$ of the toner is in the range of from about 3 to 9 $\mu$m.

According to another aspect of the invention, there is provided the electrostatic-charged image developing toner, wherein the absolute value of the electrostatically charging amount of the toner is in the range of from about 20 to 40 $\mu$C/g.

According to another aspect of the invention, there is provided a method of producing the electrostatic-charged image developer, including a step of mixing a resin fine particle dispersion having dispersed therein resin fine particles having a particle size of not more than about 1 $\mu$m, a colorant dispersion, and a lubricant dispersion to prepare a dispersion of aggregated particles containing the resin fine particles and the colorant and a step of heating the dispersion of the aggregated particles at a temperature of at least the glass transition point of the resin fine particles to melt.coalesce the aggregated particles, wherein, in the preparation step of the aggregated particles, at least one kind of a polymer of a metal salt is used.

According to another aspect of the invention, there is provided the method of producing the electrostatic-charged image developer, wherein, after the preparation step of the dispersion of the aggregated particles, a sticking step of sticking the resin fine particles to the aggregated particles by adding the dispersion of the aggregated particles to the dispersion of the resin fine particles and mixing them to form the stuck particles is provided and thereafter applying the step of melt.coalescing the stuck particles is provided.

According to another aspect of this invention, there is provided the method of producing the electrostatic-charged image developer, wherein in the step of the aggregated particles, a polymer of a metal salt is used.

According to another aspect of the invention, there is provided the method of producing the electrostatic-charged image developer, wherein as the polymer of the metal salt, a polymer of an inorganic metal salt of tetravalent aluminum is used.

According to another aspect of the invention, there is provided an electrostatic-charged image developer containing a carrier and a toner, wherein the toner is the electrostatic-charged image developing toner.

According to another aspect of the invention, there is provided an electrostatic-charged image developer, wherein the carrier has a resin coated layer.

According to another aspect of the invention, there is provided an image-forming process including a step of forming a latent electrostatic image on an electrostatic-charged image holder, a step of forming a toner image by developing the latent electrostatic image with a developer on a developer holder, a step of transferring the toner image on a transfer material, a step of transferring the toner image on the transfer material onto a transfer sheet, and a step of heat-fixing the transferred toner image, wherein, as the developer, the electrostatic-charged image developer is used.

According to another aspect of the invention, there is provided an image-forming process, wherein a step of recovering excessive toner at the formation of the toner image and a recycling step of returning the recovered toner in the recovering step onto the developer holder is provided.

DETAILED DESCRIPTION OF THE INVENTION

As the result of various investigations, the present inventors have succeeded in providing excellent fixed images excellent in the fixing characteristics such as the releasing property of the fixing sheet, the transparency of OHP images, the hot offset resistance, the sticking property of fixed images, the bending strength of the fixed images, etc., having a high charging uniformity and stability, and causing neither formation of fog nor scattering of the toner.

Then, the electrostatic-charged image developing toner of this invention and the production method thereof are described in detail.

For the toner of the invention, resin particles produced by an emulsion polymerization, etc., are used. That is, using a resin particle dispersion formed by dispersing the resin particles in an ionic surface active agent and after mixing the resin particle dispersion with a colorant dispersion formed by dispersing with an ionic surface active agent having the opposite polarity to the ionic surface active agent to cause a hetero-aggregation and to form aggregated particles having particle sizes corresponding to toner particle sizes, by heating the aggregated particles to a temperature of at least the glass transition temperature of the resin particles, the aggregated particles are melt.coalesced followed by washing and drying to obtain a toner. According to the method, the toner of a desired form ranging from an irregular form to a spherical form can be produced.

The toner can be produced by mixing all the toner components in the lump, aggregating, and melt.coalescing the aggregated particles, but, in the initial stage of the aggregating step, the balance of the amount of a polar ionic dispersing agent is previously shifted, the discrepancy of the ionic potential is moderated by using an inorganic metal salt such as calcium nitrate, etc., or a polymer of an inorganic metal salt, such as polyaluminum chloride, etc., after forming matrix aggregated particles of the 1st stage at a temperature lower than the glass transition temperature and stabilizing the particles, an addition dispersion of particles treated with a dispersing agent of a polarity and the amount for compensating the shift of the balance is added as the 2nd stage, and furthermore, if necessary, the mixture is slightly heated at a temperature lower than the glass transition temperatures of the resins contained in the matrix aggregated particles to stick the additional particles to the surfaces of the matrix aggregated particles, and, after stabilizing at a higher temperature, the matrix aggregated particles may be melt.coalesced by heating the particles to a temperature higher than the glass transition temperatures. Also, the stage wise operation of the aggregation may be repeatedly practiced plural times.

It is proper that the cumulative volume heat particle size $D_{50}$ of the toner of the invention is in the range of from about 3 to 9 $\mu$m, and preferably from about 3 to 8 $\mu$m. When the mean particle size $D_{50}$ is lower than about 3 $\mu$m, the charging property becomes insufficient to cause lowering the developing property and when the mean particle size exceeds about 9 $\mu$m, the resolving property of the image formed is lowered.

Also, it is preferred that the volume mean particle size distribution index GSDv of the toner of the invention is not more than about 1.30 and the ratio of the volume mean particle size distribution index GSDv to the number mean particle size index GSDp thereof is at least about 0.95. When the volume mean particle size distribution index GSDv exceeds about 1.30, the resolving property is lowered and when the ratio of the volume mean particle size distribution index GSDV to the number mean particle size distribution index GSDp is lower than about 0.95, the charging property is lowered and it causes image defects such as the occurrence of scattering of the toner, the formation of fog, etc.

The particle sizes and the mean particle size distribution index of the toner of the invention are obtained as follows. That is, based on the particle size distributions measured by using a measuring apparatus such as, for example, Coulter Counter TA II (manufactured by Nikkaki K.K.), Multisizer II (manufactured by Nikkaki K.K.), etc., cumulative distributions of volume and number are drawn from the small diameter side for divided particle size ranges (channels), the particle sizes becoming cumulate 16% are defined as volume $D_{16v}$ and number $D_{16p}$, respectively, the particle sizes becoming cumulate 50% are defined as volume $D_{50v}$ and number $D_{50p}$, respectively, and the particle sizes becoming cumulate 84% are defined as volume $D_{84v}$ and number $D_{84p}$, receptively. By using them, the volume mean particle size distribution index (GSDv) is calculated from $(D_{84v}/D_{16v})^{1/2}$, and the number mean particle size distribution index (GSDp) is calculated from $(D_{84p}/D_{16p})^{1/2}$.

It is proper that the charging amount of the electrostatic-charged image developing toner of this invention is from about 20 to 40 $\mu$C/g, and preferably from about 15 to 35 $\mu$C/g as the absolute value. When the charging amount is less than about 20 $\mu$C/g, a background stain (fog) is liable to form, while, when it is exceeds 40 $\mu$C/g, the image density is liable to be lowered. Also, it is proper that the ratio of the charging amount of the electrostatic-charged image developing toner in summer (high temperature and high humidity: 28° C., 85% RH) to the charging amount thereof in winter (low temperature and low humidity: 10° C., 30% RH) is in the range of from about 0.5 to 1.5, and preferably from about 0.7 to 1.3. When the charging amount of the electrostatic-charged image developing toner in summer to the charging amount thereof in winter is lower than about 0.5, the environmental dependence of the charging amount becomes strong and the stability of charging becomes undesirably poor.

As the polymer used for the resin particles of this invention, copolymer of a monofunctional monomer and a crosslinking agent (difunctional) monomer is preferably used.

There is no particular restriction on the monofunctional monomer which can be used in this invention, and examples of the monofunctional monomer include styrenes such as styrene, parachlorostyrene, α-methylstyrene, etc.; esters having vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, etc.; vinyl nitriles such as acrylonitrile, methacrylonitrile, etc.; vinyl ethers such as vinyl methyl ether, vinyl isobutyl ether, etc.; vinyl ketones such as vinyl methyl ketone, vinyl ethyl ketone, vinyl isopropenyl ketone, etc.; polyolefins such as ethylene, propylene, butadiene, etc. They maybe used singly or in combination of two or more of them.

As the crosslinking agent used in this invention, the difunctional monomer shown by the following formula is preferably used for imparting a flexibility.

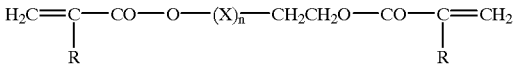

wherein X represents $CH_2$ or $CH_2CH_2O$, n represents an integer of from 4 to 14, and R represents a hydrogen atom or $CH_3$.

Also, the addition amount of the crosslinking agent to the resin fine particles is properly in the range of from 0.1 to 1.5% by weight. When the addition amount is less than about 0.1% by weight, the charging property is improved but a crosslinked structure is scarcely obtained and the durability of the images formed is scarcely improved. Also, the addition amount exceeds about 1.5% by weight, the fixing property is undesirably greatly reduced.

There is no particular restriction on the crosslinking agent used in this invention if it is shown by the above- described formula. Practical examples of the crosslinking agent which can be used in this invention include ethylene diacrylate, ethylene dimethacrylate, diethylene glycol diacrylate, diethylene glycol dimethacrylate, triethylene glycol diacrylate, triethylene glycol dimethacrylate, decaethylene glycol diacrylate, decaethylene glycol dimethacrylate, pentaethylene glycol diacrylate, pentaethylene glycol dimethacrylate, pentacontahecta diacrylate, pentacontahecta dimethacrylate, decanediol diacrylate, decanediol dimethacrylate, etc.

The inspection of the crosslinking structure (entangling structure) in the binder resin of the toner of this invention is carried out by measuring the storage elastic modulus G' and the loss elastic modulus G" by a temperature dispersion measurement in a dynamic viscoelasticity by a sinusoidal wave oscillation method.

In the temperature dispersion measurement of the dynamic viscoelasticity in this invention, usually after forming a toner into a tablet, the tablet is set in a parallel plates having a diameter of 8 mm, and after making a normal force 0, a sinusoidal wave is given at an oscillation frequency of 6.28 rad/second. The measurement is initiated from 40° C. and continued to 200° C. The interval of the measurement time is 120 seconds and the temperature-raising speed after initiation of the measurement is 1° C./minute. During measurement, at each measurement temperature, the strain amount is properly maintained and properly controlled so that an appropriate measurement value is obtained.

When a rubbery flat region (plateau region) is observed, the apparent crosslinking density is calculated by the following formula using the value of the storage elastic modulus G' at the central temperature and the density is used as the crosslinking density in the invention.

$$G'=3\phi_{en}nRT$$

($\phi_{en}$: front factor, n: crosslinking density, R: gas constant, T: temperature, G': storage elastic modulus of rubbery region)

Also, about the crosslinking molecular weight Mc, when the rubbery flat region is observed, the value of the storage elastic modulus G' at the central temperature is used, the apparent crosslinking molecular weight is obtained by the following formula and is defined as the crosslinking molecular weight Mc in the invention.

$$Mc=3dRT/G'$$

(d: toner density, R: gas constant, T: temperature)

In general, the presence or absence of the formation of crosslinkage (entanglement) of the binder resin molecular chain in the inside of the binder resin principally has a large influence on the aggregating force of the binder resin itself. That is, because the formation of a crosslinkage (entanglement) restrains the freedom of the movement of a binder molecule chain itself, the rigidity of the binder resin itself is increased. Furthermore, when the crosslinking (entangling) points are much, the above-described aggregating force is increased and the melting property of the binder resin itself is lowered.

The crosslinkage (entanglement) improves the hot offset property (HOT property) at fixing but largely lower the bending resistance of the fixing sheet and the gloss of the fixed image. The crosslinking (entangling) state is generally expressed by the crosslinking molecular weight and the crosslinking density. When the crosslinking density is higher and the crosslinking amount is smaller, the rigidity of the binder resin, that is, of the fixed toner layer is larger. On the other hand, it is important to keep the fixing property of the toner to a fixing sheet and to keep the flexibility of the fixed image itself to some extent and by only the introduction of an ordinary crosslinking (entangling) structure, it is difficult to simultaneously satisfy the fixing property of a fixing sheet and a fixed image at bending the image and the hot offset property. Consequently, the control of the crosslinking density and the crosslinking molecular weight expressing the extent and the strength of the crosslinking (entangling) structure becomes important.

In this invention, the crosslinking molecular weight Mc obtained by the temperature diffusion measurement in the dynamic viscoelasticity of the toner is preferably in the range of from about $1.6\times10^4$ to $3.5\times10^6$, and particularly preferably in the range of from about $3.0\times10^4$ to $9.0\times10^5$. When the Mc is smaller than about $1.6\times10^4$, the rigidity of the crosslinkage (entanglement) is increased and the hot offset property is improved but the bending strength of the fixed image formed is greatly lowered. Also, when the Mc exceeds about $3.5\times10^6$, even when the crosslinkage (entanglement) of the toner occurs, the freedom of the movement of the crosslinked (entangled) molecular chain itself is increased and the offset property is lost.

About the crosslinking density in the invention, the crosslinking density Me obtained by the temperature diffusion measurement in the dynamic viscoelasticity of the toner is in the range of preferably from about $1.6\times10^{-8}$ to $3.5\times10^{-6}$/Kmol, and particularly preferably from about $2.0\times10^{-8}$ to $3.2\times10^{-6}$/Kmol. When the Me is smaller than about $1.6\times10^{-8}$/Kmol, a substantial crosslinking (entangling) structure is not formed and the hot offset property is lowered. Also, when the Me exceed $3.5\times10^{-6}$/Kmol, the moving property of the molecular chain of the binder resin itself is hindered, the rigidity is increased, and as the result thereof, the bonding resistance of the fixed image fixed on a fixing sheet is reduced.

When a vinyl-based monomer is used as a monomer component of the binder resin in this invention, using an ionic surface active agent, etc., a resin particle dispersion can be prepared by practicing an emulsion polymerization. When other resin is used, if the resin is dissolved in a solvent which is oily and has a relatively low solubility in water, resin is dissolved in the solvent, the solution is dispersed in water as fine particles together with an ionic surface active agent and a high molecular weight electrolyte by a dispersing apparatus such as a homogenizer, etc., and thereafter by evaporating off the solvent by heating or reducing pressure, a resin dispersion can be prepared.

The particle sizes of the resin fine particle dispersion obtained are measured, for example, by a laser diffraction type particle size distribution measurement apparatus (LA-700, manufactured by HORIBA, LTD.).

It is proper that the central particle size of the resin fine particles used in the invention is in the range of from about 50 to 400 nm, and preferably from about 70 to 350 nm. When the central particle size is shorter than about 50 nm, the aggregating property is deteriorated a little and the productivity is liable to be lowered, while, when the central diameter exceeds about 400 nm, the aggregating property is good but, because the aggregated product becomes rough, the form controlling property is lowered.

The glass transition temperature (Tg) of the toner of the invention is from about 50 to 65° C., and preferably from about 52 to 60° C. When the Tg is lower than about 50° C., because the aggregating force of the binder resin itself at a high-temperature region is lowered, a hot offset is liable to form at fixing and when the Tg exceeds 65° C., sufficient melting of the binder resin is not obtained and the bending resistance of a fixing sheet is sometimes reduced.

As the surface lubricant used in this invention, substances whose main body maximum endothermic peak as measured according to ASTM D3418-8 is in the range of from about 50 to 140° C. are preferred. When the peak value is lower than about 50° C., an offset is liable to occur at fixing. Also, the peak value exceeds 140° C., the fixing temperature becomes high, the smoothness of the surface of the fixed image is not obtained, and the gloss of the fixed image is reduced.

For the measurement of the main body maximum endothermic peak in this invention, for example, a differential thermal calorimeter, DSC-7 manufactured by Parkin Elmer Co., is used. For the temperature correction of the detecting portion of the apparatus, the melting points of indium and zinc are used and for the correction of the quantity of heat, the melting heat of indium is used. For the sample, an aluminum-made pan is used, a hollow pan is set for contrast, and the measurement is carried out at a heating rate of 10° C./minute.

It is proper that the content of the surface lubricant dispersed in the toner of the invention is in the range of from about 5 to 25% by weight in terms of solid content, and preferably from about 7 to 15% by weight. It is preferred that the surface lubricant is added before the additional particles are stuck to the toner from the points of the charging property and the durability The central diameter (median diameter) of the surface lubricant particles dispersed in the toner of the invention is preferably in the range of from about 150 to 1500 nm as measured by a transmission electron microscope (TEM).

Examples of the surface lubricant which can be used in the invention include low molecular weight polyolefins such as polyethylene, polypropylene, polybutene, etc.; silicones having a softening point by heating; fatty acid amides such as oleic acid amide, erucic acid amide, ricinolic acid amide, stearic acid amide, etc.; vegetable waxes such as a carnauba wax, a rice wax, a candelilla wax, a Japan wax, a jojoba oil, etc.; animal oils such as a beeswax, etc.; mineral waxes and petroleum waxes, such as a montan wax, ozokerite, cerecin, a paraffin wax, a microcrystalline wax, a Fischer-Tropsch wax, etc.; and denatured products thereof.

The lubricant (waxes) is dispersed in water together with an ionic surface active agent and high molecular electrolyte such as a high molecular acid, a high molecular base, etc., and by finely granulating by applying a strong shear while heating to a temperature of at least the melting point using a homogenizer or a pressure spray type dispersing apparatus, a dispersion of the fine particles thereof having particle sizes of not larger than 1 $\mu$m can be prepared.

Also, the particle sizes of the lubricant particle dispersion obtained are measured by, for example, a laser diffraction type particle size distribution measurement apparatus (LA-700, manufactured by HORIBA, LTD.).

It is proper that the central particle size of the lubricant particles used in this invention is in the range of from about 50 to 400 nm, and preferably from about 70 to 350 nm. When the central particle size is smaller than about 50 nm, the oozing property of the lubricant at fixing is liable to be lowered to sometimes cause inferior releasing. Also, when it exceeds 400 nm, at the aggregation, lubricant particles having 1500 nm or larger are liable to form, whereby the transparency of OHP images is sometimes lost.

The colorant used in this invention is selected from the view points of the hue, the saturation, the lightness, the weather resistance, the OHP transparency, and the dispersibility in the toner.

For example, as a black pigment, there are carbon black, copper oxide, manganese dioxide, aniline black, active carbon, non-magnetic ferrite, magnetite, etc.

As a yellow pigment, there are chrome yellow, zinc yellow, yellow iron oxide, Cadmium Yellow, Hansa Yellow, Hansa Yellow 10G, Benzidine Yellow G, Benzidine Yellow, Sullen Yellow, Quinoline Yellow, Permanent Yellow NCG, etc.

As an orange pigment, there are red chrome yellow, Molybdenum Orange, Permanent Orange GTR, Pyrazolone Orange, Vulcan Orange, Benzidine Orange, Benzidine Orange G, Indanthrene Brilliant Orange RK, Indanthrene Brilliant Orange GK, etc.

As a red pigment, there are red iron oxide, Cadmium Red, red lead, mercury sulfide, Watchung Red, Permanent Red 4R, Lithol Red, Brilliant Carmine 6B, Du Pont Oil Red, Pyrazolone Red, Rhodamine B Lake, Lake Red C, Rose Bengal, Eoxine Red, Alizarin Lake, etc.

As a blue pigment, there are Prussian Blue, Cobalt Blue, Alkali Blue Lake, Victoria Blue Lake, Fast Sky Blue, Indanthrene Blue BC, Aniline Blue, Ultramarine Blue, Chalco Oil Blue, Styrene Blue Chloride, Methylene Blue Chloride, Phthalocyanine Green, Malachite Green, Oxare Late, etc.

As a violet pigment, there are Manganese Violet, Fast Violet B, Methyl Violet Lake, etc.

As a green pigment, there are chromium oxide, Chrome Green, Pigment Green, Malachite Green Lake, Final Yellow Green G, etc.

As a white pigment, there are zinc white, titanium oxide, Antimony White, zinc sulfide, etc.

As a filler, there are baryta powder, barium carbonate, clay, silica, white carbon, talc, alumina white, etc.

Also, as a dye, there are various dyes such as basic dyes, acid dyes, disperse dyes, direct dyes, etc., and practical examples include Nigrosine, Rose Bengal, Quinoline Yellow, Ultramarine Blue, etc.

Also, they can be used singly or a mixture thereof, or can be used as a solid solution state.

The colorant is dispersed in a dispersion by a known method, and in this case, for example, a media type dispersing apparatus, such as a rotary shearing type homogenizer, a ball mill, an attritor, etc.; and a high-pressure counter impact type dispersing apparatus, etc., are preferably used.

Also, the particle size of the colorant particle dispersion obtained are measured by, for example, a laser diffraction particle size distribution measurement apparatus (LA-700, manufactured by HORIBA, LTD.).

The central diameter (median diameter) of the colorant particles in the toner of the invention is preferably in the range of from about 100 to 330 nm as measured by a transmission electron microscope (TEM).

The proper content of the colorant in the toner of the invention is in the range of from about 1 to 20 parts by weight in terms of solid content based on 100 parts by weight of the resin.

In the case of using a magnetic substance as a black colorant, the content thereof is different from the case of other colorant and it is better to incorporate the colorant in the range of from about 30 to 100 parts by weight.

Also, when the toner is used as a magnetic toner, the toner may contain a magnetic powder. As such a magnetic powder, a substance which is magnetized in a magnetic field is used, and, as the magnetic powder, the powder of a ferromagnetic substance such as iron, cobalt, nickel, etc., or the powder of a compound such as ferrite, magnetic, etc., is used.

In addition, because in this invention, the toner is produced in water, it is required to pay attention to the shifting property of the magnetic substance into water, and it is preferred to modify the surface of the magnetic substance by applying a hydrophobic treatment to the surface.

The shape factor SF1 of the toner of this invention is preferably in the range of from about 110 to 145 from the point of the image-forming property. When the shape factor is below about 110, it is very difficult to stably produce the toner, whereby the yield is lowered and the production become disadvantageous in cost. Also, when the shape factor exceeds 145, the transferring property in an electrophotographic process is undesirably lowered.

The shape factor SF1 is the value obtained by dividing (the square of the peripheral length of a toner) by (the projected area of the toner) and is calculated by the following method. That is, the light microscopie image of a toner spread on a slide glass is taken in a Ruzex image analyzing apparatus through a video camera, the values of [square ($ML^2$) of the peripheral length/projected area (A)] of more than 50 toners are calculated, and the mean value thereof is employed as the shape factor.

The toner of the invention can contain a charge controlling agent for more improving and stabilizing the charging property of the toner. The charge controlling agent used in the invention includes charge controlling agents usually used, such as quaternary ammonium salt compounds, Nigrosine-based compounds, dyes made of complexes of aluminum, iron, chromium, etc.; triphenylmethane-based pigments, etc., but from the points of the control of the ionic strength giving the stability at the aggregation and the coalescence and the reduction of stains by waste water, a material which is hard to dissolve in water is suitable.

In this invention, inorganic fine particles can be added to the toner by a wet system for stabilizing the charging property. As the examples of the inorganic fine particles added to the toner, the materials usually used by externally adding to the surface of a toner, such as silica, alumina, titania, calcium carbonate, magnesium carbonate, tricalcium phosphate, etc., can be used by dispersing them in an ionic surface active agent, a high molecular acid, a high molecular base, etc.

Also, for the purpose of imparting the fluidity to the toner and improving the cleaning property of the toner, similarly for an ordinary toner, after drying the toner, inorganic fine particles of silica, alumina, titania, calcium carbonate, etc.; vinyl-based resin fine particles; or fine particles of a resin such as polyester, silicone, etc., can be added to the surface of the toner by applying shear in a dried state.

As the surface active agents used for the emulsion polymerization, the dispersion of the colorant, the dispersion of the resin fine particles, the dispersion of the lubricant, the aggregation or the stabilization thereof, etc., in the production method of the toner of this invention, it is effective to use together a sulfuric acid ester-based, sulfonate-based, phosphoric acid ester-based, soap-based anionic surface active agent, etc.; an amine salt-based, quaternary ammonium salt-based cationic surface active agent, etc., or a polyethylene glycol-based, alkylphenol ethylene oxide addition product-based, polyhydric alcohol-based nonionic surface active agent, etc.

As a dispersing means, a rotary shearing type homogenizer, or a dispersing apparatus having media, such as a ball mill, a sand mill, a Dyno mill, etc., can be used.

Also, in the case of using a composite made of a resin and a colorant, the composite can be prepared by a method of dissolving or dispersing the resin and the colorant in a solvent, dispersing the dispersion in water together with a property dispersing agent, and obtaining the composite by removing the solvents by heating or under a reduced pressure, a method of imparting the colorant to the surfaces of the resin fine particles prepared by an emulsion polymerization by a mechanical shearing force, or a method of electrically adsorbing the colorant onto the resin and fixing thereto. These methods are effective for restraining the occurrence of the liberation of the colorant as an addition particles and improving the colorant dependence of the charging property.

After finishing polymerization, a desired toner is obtained through an optional washing step, a solid-liquid separation step, and a drying step, and in this case in the washing step, from the point of charging property, it is preferred to sufficiently apply a displacement washing with ion-exchanged water. Also, there is no particular restriction on the solid-liquid separation step, but from the point of the productivity, a suction filtration, a pressure filtration, etc., is preferably used. There is also no particular restriction on the drying step, but from the point of the productivity, a lyophilization, flash jet drying, fluid drying, vibration type fluid drying, etc., is preferably used.

In the present invention, by employing the above-described construction, an excellent fixed image excellent in the releasing property of the fixing sheet, the OHP transparency, the hot offset property, the sticking property of the fixed images, the bending strength of the fixed images, etc., having a high charging uniformity and stability, and giving neither fog nor scattering toner can be provided.

Then, the present invention is described in detail by the following examples but the invention is not limited to these examples.

The toner of the invention is generally prepared as follows. That is, each of the resin fine particle dispersion, the colorant dispersion, and the lubricant dispersion described below is prepared, while mixing these dispersions at a definite ratio and stirring the mixture, a polymer of an inorganic metal salt is added to the mixture to tonically neutralize the mixture, whereby aggregated particles are formed. After adjusting the pH in the system from a weak acidic property to neutral with an inorganic hydroxide, the mixture is heated to a temperature of at least the glass transition temperature of the above-described resin fine particles and the temperature is further raised to a temperature of melting and coalescing the mixture. After reaching the melt.coalescing temperature, the pH in the system is adjusted from a weak acidic property to an acidic property and heating is continued. After the reaction is over, a desired toner is obtained through a sufficient washing step, a solid-liquid separation step, and a drying step.

Then, the preparation method of each of the dispersions and the toners is explained.

Preparation of resin fine particle dispersion 1:

| | |
|---|---|
| Styrene | 320 parts by weight |
| n-Butyl acrylate | 80 parts by weight |
| Acrylic acid | 6 parts by weight |
| Crosslinking agent (1) | 2.6 parts by weight |

A solution is prepared by mixing and dissolving the above-described components (total weights 412.6 g). On the other hand, 6 g of a nonionic surface active agent (Nonipol 400, made by Kao Corporation) and 19 g of an anionic surface active agent (Neogen SC, made by DAI-ICHI KOGYO SEIYAKU CO., LTD.) are dissolved in 550 g of ion-exchanged water, the above-described solution to the solution and dispersed and emulsified in a flask, and while slowly stirring and mixing, 50 g of ion-exchanged water having dissolved therein 4 g of ammonium persulfate is added to the emulsion formed. Then, after sufficiently replacing the inside of the system with nitrogen, the mixture in the flask is heated with stirring to 70° C. with an oil bath, and the emulsion polymerization is continued for 5 hours at the same temperature to obtain an anionic resin fine particle dispersion 1 containing resin fine particles having a central diameter of 164 nm, a glass transition temperature of 58° C. and Mw of 53,700.

Preparation of resin fine particle dispersion 2:

By following the same procedure as in the preparation of resin fine particle dispersion 1 except that the compounding amount of the crosslinking agent (I) is changed to 0.7 part by weight in the preparation of resin fine particle dispersion 1, a cationic resin fine particle dispersion 2 containing resin fine particles having a central diameter of 171 nm, a glass transition temperature of 57° C. and Mw of 34,100 is obtained.

Preparation of resin fine particle dispersion 3:

By following the same procedure as in the preparation of the resin fine particle dispersion 1 except that in the preparation of the resin fine particle dispersion 1, in the compounding amounts styrene is changed to 300 parts by weight, n-butyl acrylate to 100 parts by weight, and dodecanethiol to 8 parts by weight, and the crosslinking agent (I) (made by Shin Nakamura Kagaku K.K.) to 8.9 parts by weight, a cationic resin fine particle dispersion 3 containing resin fine particles having a central diameter of 171 nm, a glass transition temperature of 51° C., and Mw of 79,300 is obtained.

Preparation of resin fine particle dispersion 4:

By following the same procedure as in the preparation of the resin fine particle dispersion 1 except that in the preparation of the resin fine particle dispersion 1, 2.67 parts by weight of crosslinking agent (II) (NK ester, made by Shin Nakamura Kagaku K.K.), $H_2C{=}CH{-}CO{-}O{-}(CH_2)_4{-}CH_2CH_2O{-}CO{-}CH{=}CH_2$ is used in place of the crosslinking agent (I) and the amount of dodecanethiol is changed to 8 parts by weight, a cationic resin fine particle dispersion 4 containing resin fine particles having a central diameter of 157 nm, a glass transition temperature of 58° C., and Mw of 37,600 is obtained.

Preparation of resin fine particle dispersion 5:

By following the same procedure as in the preparation of resin fine particle dispersion 1 except that in the preparation of resin fine particle dispersion 1, the amount of styrene is changed to 300 parts by weight, and that of n-butyl acrylate to 100 parts by weight, and 2.67 parts by weight of crosslinking agent (III) (NK ester, made by Shin Nakamura Kagaku K.K.), $H_2C{=}CH{-}CO{-}O{-}(CH_2)_{14}{-}CH_2CH_2O{-}CO{-}CH{=}CH_2$ is used in place of the crosslinking agent (I), and the amount of dodecanethiol is changed to 8 parts by weight, a cationic resin fine particle dispersion 5 containing resin fine particles having a central diameter of 163 nm, a glass transition temperature of 53° C., and Mw of 64,500 is obtained.

Preparation of resin fine particle dispersion 6:

By following the same procedure as in the preparation of resin fine particle dispersion 1 except that in the preparation of resin fine particle dispersion 1, 2.67 parts by weight of crosslinking agent (IV) (NK ester, made by Shin Nakamura Kagaku K.K.), $H_2C{=}CH{-}CO{-}O{-}(CH_2CH_2O)_{13}{-}CH_2CH_2O{-}CO{-}CH{=}CH_2$ is used in place of the crosslinking agent (I) and the amount of dodecanethiol is changed to 8 parts by weight, a cationic resin fine particle dispersion 6 containing resin fine particles having a central diameter of 151 nm, a glass transition temperature of 55° C., and Mw of 59,300 is obtained.

Preparation of resin fine particle dispersion 7:

By following the same procedure as in the preparation of resin fine particle dispersion 1 except that in the preparation of resin fine particle dispersion 1, 2.67 parts by weight of crosslinking agent (V) (NK ester, made by Shin Nakamura Kagaku K.K.), $H_2C{=}C(CH_3){-}CO{-}O{-}(CH_2)_8{-}CH_2CH_2O{-}CO{-}C(CH_3){=}CH_2$ is used in place of the crosslinking agent (I), a cationic resin fine particle dispersion 7 containing resin fine particles having a central diameter of 161 nm, a glass transition temperature of 62° C., and Mw of 61,900 is obtained.

Preparation of resin fine particle dispersion 8:

By following the same procedure as in the preparation of resin fine particle dispersion 1 except that in the preparation of resin fine particle dispersion 1, 2.67 parts by weight of crosslinking agent (VI) (NK ester, made by Shin Nakamura Kagaku K.K.), $H_2C{=}C(CH_3){-}CO{-}O{-}(CH_2)_4{-}CH_2CH_2O{-}CO{-}C(CH_3){=}CH_2$ is used in place of the crosslinking agent (I) and the amount of dodecanethiol is changed to 8 parts by weight, a cationic resin fine particle dispersion 8 containing resin fine particles having a central diameter of 163 nm, a glass transition temperature of 55° C., and Mw of 74,300 is obtained.

Preparation of resin fine particle dispersion 9:

By following the same procedure as in the preparation of resin fine particle dispersion 1 except that in the preparation of resin fine particle dispersion 1, the amount of the crosslinking agent (I) is changed to 0.2 part by weight and that of dodecanethiol to 8 parts by weight, a cationic resin fine particle dispersion 9 containing resin fine particles having a central diameter of 160 nm, a glass transition temperature of 56° C., and Mw of 41,100 is obtained.

Preparation of resin fine particle dispersion 10:

By following the procedure of the preparation of resin fine particle dispersion 1 except that in the preparation of resin fine particle dispersion 1, the amount of styrene is changed to 300 parts by weight, that of n-butyl acrylate to 100 parts by weight, and that of dodecanethiol to 8 parts by weight, and the crosslinking agent (I) (made by Shin Nakamura Kagaku K.K.) to 6.8 parts by weight, a cationic resin fine particle dispersion 10 containing resin fine particles having a central diameter of 157 nm, a glass transition temperature of 53° C., and Mw of 83,500 is obtained.

Preparation of resin fine particle dispersion 11:

By following the same procedure as in the preparation of resin fine particle dispersion 1 except that in the preparation of resin fine particle dispersion 1, 2.67 parts by weight of crosslinking agent (VII) (NK ester, made by Shin Nakamura K.K.), $H_2C{=}C(CH_3){-}CO{-}O{-}(CH_2CH_2O)_{13}{-}CH_2CH_2O{-}CO{-}C(CH_3){=}CH_2$ is used in place of the crosslinking agent (I) , a cationic resin fine particle dispersion 11 containing resin fine particles having a central diameter of 159 nm, a glass transition temperature of 59° C., and Mw of 73,600 is obtained.

Preparation of resin fine particle dispersion 12:

By following the same procedure as in the preparation of resin fine particle dispersion 1 except that the crosslinking agent is omitted, a cationic resin fine particle dispersion 12 containing resin fine particles having a central diameter of 154 nm, a glass transition temperature of 56° C., and Mw of 27,300 is obtained.

Preparation of colorant dispersion 1:

| | |
|---|---|
| Cyan pigment (Copper Phthalocyanine B15:3, made by DAINICHISEIKA COLOR & CHEMICALS MFG. CO., LTD.) | 50 parts by weight |
| Nonionic surface active agent (Nonipol, made by Kao Corporation) | 5 parts by weight |
| Ion-exchanged water | 200 parts by weight |

The above-described components are mixed and dissolved, and, by dispersing the mixture for 10 minutes by a homogenizer (Ultratalax, made by IKA Co.), a coloring agent dispersion 1 containing colorant particles having a central diameter of 168 nm is obtained.

Preparation of colorant dispersion 2:

By following the same procedure as in the preparation of colorant dispersion 1 except that a yellow pigment (PY 180, made by Clariant Japan K.K.) is used as a colorant in the same amount, a colorant dispersion 2 containing colorant particles having a central diameter of 177 nm is obtained.

Preparation of colorant dispersion 3:

By following the same procedure as in the preparation of colorant dispersion 1 except that a magenta pigment (PR 122, made by DAINIPPON INK AND CHEMICALS, INC.) is used as a colorant in the same amount, a colorant dispersion 3 containing colorant particles having a central diameter of 186 nm is obtained.

Preparation of colorant dispersion 4

By following the same procedure as in the preparation of colorant dispersion 1 except that a black pigment (carbon black, made by Cabot Co.) is used as a colorant in the same amount, a colorant dispersion 4 containing colorant particles having a central diameter of 159 nm is obtained.

Preparation of lubricant dispersion 1:

| | |
|---|---|
| Paraffin wax (HNP0190, m.p. 35° C., made by Nihon Seiroo K.K.) | 50 parts by weight |
| Cationic surface active agent (Sanisol B50, made by Kao Corporation) | 5 parts by weight |
| Ion-exchanged water | 200 parts by weight |

After heating the mixture of the above-described components to 95° C. and sufficiently dispersing it by Ultralax T50, made by IKA Co., a dispersing treatment is applied by a pressure spraying type homogenizer to obtain a lubricant dispersion containing lubricant particles having a central diameter of 180 nm.

Production of toner 1:

| | |
|---|---|
| Resin fine particle dispersion 1 | 200 parts by weight |
| Colorant dispersion 1 | 28 parts by weight |
| Lubricant dispersion 1 | 37 parts by weight |
| Polyaluminum chloride | 1.23 parts by weight |

After sufficiently dispersing the mixture of the above-described components in a round stainless steel-made flask by a homogenizer (Ultratalax T50, made by IKE Co.), the flask is heated to an aggregation temperature 56° C. by an oil bath for heating with stirring. Thereafter, after keeping for 60 minutes at 56° C., 30 parts by weight of the resin fine particle dispersion 1 is additionally added and the resulting mixture is slowly stirred.

Thereafter, after adjusting the pH in the inside of the system with an aqueous solution of 0.5 mol/liter of sodium hydroxide, the stainless steel-made flask is closed and is heated to 97° C. with stirring using a magnet seal. Thereafter, the pH of the system is lowered to 4.0 and kept for 6 hours. After the reaction is over, the product is cooled and filtered, and after sufficiently washing the product with ion-exchanged water, a solid-liquid separation is applied by a Nutsche type suction filtration. Furthermore, the product is dispersed again in 3 liters of ion-exchanged water at 40° C. and washed by stirring at 300 rpm. for 15 minutes.

After repeating the washing operation 5 times, a solid-liquid separation is carried out using a No. 5A filter paper by a Nutsche type suction filtration. Then, vacuum drying is continued for 12 hours to obtain toner 1.

When the toner particle sizes are measured by a Coulter counter, the cumulative volume mean particle size $D_{50}$ is 5.1 μm and the volume mean particle size distribution index GSDv is 1.21. Also, the ratio of the volume mean particle size distribution index GSDv to the number mean particle size distribution index GSDp is 1.10.

Furthermore, the shape factor SF1 of the particles obtained by the shape observation by Ruzex is 114, which shows that the shape is of a spherical form. When the cross-section image of the toner is observed by a transmission electron microscope (TEM), the lubricant is dispersed in the toner particles, the central diameter (median diameter) of the lubricant is 310 nm, and the particle size (median diameter) of the colorant is 174 nm.

Production of toner 2:

By following the same procedure as in the production of toner 1 except that in the production of toner 1, the addition amount of the lubricant dispersion 1 is changed to 10.0% by weight in terms of solid content, the addition amount of the colorant dispersion 1 to 14.5% by weight in terms of solid content, the aggregation temperature is changed to 40° C., and the pH in the inside of the system when the temperature reaches 97° C. after stopping the aggregation is adjusted to 4.0, toner 2 is obtained.

The cumulative volume mean particle size $D_{50}$ of the toner is 3.3 μm and the volume mean particle size distribution index GSDV is 1.23. Also, the ratio of the volume mean particle size distribution index GSDv to the number mean particle size distribution index GSDp is 1.01. Also, the shape factor SF1 is 130 and it is observed that the toner has almost a round potato form. When the cross-section image of the toner is observed by a transmission electron microscope (TEM), the lubricant is dispersed in the toner particles, the central diameter (median diameter) of the lubricant is 390 nm, and the particle size (median diameter) of the colorant is 311 nm.

Production of toner 3:

By following the same procedure as in the production of toner 1 except that in the production of toner 1, the addition amount of the lubricant dispersion 1 is changed to 15.0% by weight in terms of solid content, the addition amount of the colorant dispersion 1 to 4.5% by weight in terms of solid content, the aggregation temperature is changed to 60° C., and the pH in the inside of the system when the temperature reaches 97° C. after stopping the aggregation is adjusted to 5.0, toner 3 is obtained.

The cumulative volume mean particle size $D_{50}$ Of the toner is 8.7 μm and the volume mean particle size distribution index GSDv is 1.19. Also, the ratio of the volume mean particle size distribution index GSDv to the number mean particle size distribution index GSDp is 0.98. Also, the shape factor SF1 is 139 and it is observed that the toner has a potato form. When the cross-section image of the toner is observed by a transmission electron microscope (TEM) the lubricant is dispersed in the toner particles, the central diameter (median diameter) of the lubricant is 190 nm, and the particle size (median diameter) of the colorant is 214 nm.

Preparation of toner 4:

By following the same procedure as in the production of toner 1 except that in the production of toner 1, the resin fine particle dispersion 2 is used, the addition amount of the lubricant dispersion 1 is changed to 8.0% by weight in terms of solid content, the addition amount of the colorant dispersion 1 to 6.0% by weight in terms of solid content, the aggregation temperature is changed to 55° C., the pH in the inside of the system when the temperature reaches 97° C. after stopping the aggregation is adjusted to 3.8, and the melt.coalescence time is changed to 10 hours, toner 4 is obtained.

The cumulative volume mean particle size $D_{50}$ of the toner is 4.9 μm and the volume mean particle size distribution index GSDv is 1.24. Also, the ratio of the volume mean particle size distribution index GSDv to the number mean particle size distribution index GSDp is 1.17. Also, the shape factor SF1 is 122 and it is observed that the toner has a spherical form. When the cross-section image of the toner is observed by a transmission electron microscope (TEM), the lubricant is dispersed in the toner particles, the central diameter (median diameter) of the lubricant is 1120 nm, and the particle size (median diameter) of the colorant is 106 nm.

Preparation of toner 5:

By following the same procedure as in the production of toner 1 except that in the production of toner 1, the resin fine particle dispersion 2 is used, the addition amount of the lubricant dispersion 1 is changed to 10.0% by weight in terms of solid content, the addition amount of the colorant dispersion 1 to 5.0% by weight in terms of solid content, the aggregation temperature is changed to 56° C., the pH in the inside of the system when the temperature reaches 97° C. after stopping the aggregation is adjusted to 5.5, and the melt.coalescence time is changed to 10 hours, toner 5 is obtained.

The cumulative volume mean particle size $D_{50}$ of the toner is 6.2 μm and the volume mean particle size distribution index GSDv is 1.19. Also, the ratio of the volume mean particle size distribution index GSDv to the number mean particle size distribution index GSDp is 1.10. Also, the shape factor SF1 is 123 and it is observed that the toner has a round potato form. When the cross-section image of the toner is observed by a transmission electron microscope (TEM), the lubricant is dispersed in the toner particles, the central diameter (median diameter) of the lubricant is 1390 nm, and the particle size (median diameter) of the colorant is 152 nm.

Production of toner 6:

By following the same procedure as in the production of toner 1 except that in the production of toner 1, the resin fine particle dispersion 2 is used, the addition amount of the lubricant dispersion 1 is changed to 15.0% by weight in terms of solid content, the addition amount of the colorant dispersion 1 to 5.0% by weight in terms of solid content, the aggregation temperature is changed to 55° C., the pH in the inside of the system when the temperature reaches 97° C. after stopping the aggregation is adjusted to 6.5, and the melt.coalescence time is changed to 10 hours, toner 6 is obtained.

The cumulative volume mean particle size $D_{50}$ of the toner is 6.5 μm and the volume mean particle size distribution index GSDv is 1.25. Also, the ratio of the volume mean particle size distribution index GSDv to the number mean particle size distribution index GSDp is 1.10. Also, the shape factor SF1 is 137 and it is observed that the toner has a round potato form. When the cross-section image of the toner is observed by a transmission electron microscope (TEM), the lubricant is dispersed in the toner particles, the central diameter (median diameter) of the lubricant is 1440 nm, and the particle size (median diameter) of the colorant is 322 nm.

Production of toner 7:

By following the same procedure as in the production of toner 1 except that in the production of toner 1, the resin fine particle dispersion 3 is used, the addition amount of the lubricant dispersion 1 is changed to 5.0% by weight in terms of solid content, the addition amount of the colorant dispersion 1 to 14.5% by weight in terms of solid content, the aggregation temperature is changed to 48° C., the pH in the inside of the system when the temperature reaches 97° C. after stopping the aggregation is adjusted to 6.5, and the melt.coalescence time is changed to 5 hours, toner 7 is obtained.

The cumulative volume mean particle size $D_{50}$ of the toner is 3.4 μm and the volume mean particle size distribution index GSDv is 1.23. Also, the ratio of the volume mean particle size distribution index GSDv to the number mean particle size distribution index GSDp is 0.97. Also, the shape factor SF1 is 136 and it is observed that the toner has a round potato form. When the cross-section image of the toner is observed by a transmission electron microscope (TEM), the lubricant is dispersed in the toner particles, the central diameter (median diameter) of the lubricant is 290 nm, and the particle size (median diameter) of the colorant is 220 nm.

Production of toner 8:

By following the same procedure as in the production of toner 1 except that in the production of toner 1, the resin fine particle dispersion 3 is used, the addition amount of the lubricant dispersion 1 is changed to 7.0% by weight in terms of solid content, the addition amount of the colorant dispersion 1 to 4.0% by weight in terms of solid content, the aggregation temperature is changed to 49° C., and the pH in the inside of the system when the temperature reaches 97° C. after stopping the aggregation is adjusted to 4.5, toner 8 is obtained.

The cumulative volume mean particle size $D_{50}$ of the toner is 8.9 μm and the volume mean particle size distribution index GSDv is 1.22. Also, the ratio of the volume mean particle size distribution index GSDv to the number mean particle size distribution index GSDp is 1.14. Also, the shape factor SF1 is 127 and it is observed that the toner has a round potato form. When the cross-section image of the toner is observed by a transmission electron microscope (TEM), the lubricant is dispersed in the toner particles, the central diameter (median diameter) of the lubricant is 320 nm, and the particle size (median diameter) of the colorant is 117 nm.

Production of toner 9:

By following the same procedure as in the production of toner 1 except that in the production of toner 1, the resin fine particle dispersion 3 is used, the addition amount of the lubricant dispersion 1 is changed to 9.0% by weight in terms of solid content, the addition amount of the colorant dispersion 1 to 5.0% by weight in terms of solid content, the aggregation temperature is changed to 48° C., the pH in the inside of the system when the temperature reaches 97° C. after stopping the aggregation is adjusted to 3.6, and the melt.coalescence time is changed to 4 hours, toner 9 is obtained.

The cumulative volume mean particle size $D_{50}$ of the toner is 6.6 μm and the volume mean particle size distribution index GSDv is 1.24. Also, the ratio of the volume mean particle size distribution index GSDv to the number mean particle size distribution index GSDp is 1.11. Also, the shape factor SF1 is 118 and it is observed that the toner has a spherical form. When the cross-section image of the toner is observed by a transmission electron microscope (TEM), the lubricant is dispersed in the toner particles, the central diameter (median diameter) of the lubricant is 840 nm, and the particle size (median diameter) of the colorant is 206 nm.

Production of toner 10:

By following the same procedure as in the production of toner 1 except that in the production of toner 1, the addition amount of the lubricant dispersion 1 is changed to 8.0% by weight in terms of solid content, magenta colorant dispersion 3 is used and the addition amount thereof is changed to 7.5% by weight in terms of solid content, the pH in the inside of the system when the temperature reaches 97° C. after stopping the aggregation is adjusted to 4.4, and the melt•coalescence time is changed to 5 hours, toner 10 is obtained.

The cumulative volume mean particle size $D_{50}$ of the toner is 5.3 μm and the volume mean particle size distribution index GSDv is 1.19. Also, the ratio of the volume mean particle size distribution index GSDv to the number mean particle size distribution index GSDp is 1.07. Also, the shape factor SF1 is 128 and it is observed that the toner has a round potato form. When the cross-section image of the toner is observed by a transmission electron microscope (TEM), the lubricant is dispersed in the toner particles, the central diameter (median diameter) of the lubricant is 220 nm, and the particle size (median diameter) of the colorant is 132 nm.

Production of toner 11:

By following the same procedure as in the production of toner 1 except that in the production of toner 1, the addition amount of the lubricant dispersion 1 is changed to 8.0% by weight in terms of solid content, yellow colorant dispersion 2 is used and the addition amount thereof is changed to 10.0% by weight in terms of solid content, the pH in the inside of the system when the temperature reaches 97° C. after stopping the aggregation is adjusted to 4.6, and the melt.coalescence time is changed to 4 hours, toner 11 is obtained.

The cumulative volume mean particle size $D_{50}$ of the toner is 5.1 μm and the volume mean particle size distribution index GSDv is 1.22. Also, the ratio of the volume mean particle size distribution index GSDv to the number mean particle size distribution index GSDp is 1.11. Also, the shape factor SF1 is 130 and it is observed that the toner has a round potato form. When the cross-section image of the toner is observed by a transmission electron microscope (TEM), the lubricant is dispersed in the toner particles, the central diameter (median diameter) of the lubricant is 210 nm, and the particle size (median diameter) of the colorant is 130 nm.

Production of toner 12:

By following the same procedure as in the production of toner 1 except that in the production of toner 1, the addition amount of the lubricant dispersion 1 is changed to 8.0% by weight in terms of solid content, black colorant dispersion 4 is used and the addition amount thereof is changed to 6.0% by weight in terms of solid content, and the pH in the inside of the system when the temperature reaches 97° C. after stopping the aggregation is adjusted to 4.8, toner 12 is obtained.

The cumulative volume mean particle size $D_{50}$ of the toner is 5.2 μm and the volume mean particle size distribution index GSDv is 1.20. Also, the ratio of the volume mean particle size distribution index GSDv to the number mean particle size distribution index GSDp is 1.06. Also, the shape factor SF1 is 130 and it is observed that the toner has a round potato form. When the cross-section image of the toner is observed by a transmission electron microscope (TEM), the lubricant is dispersed in the toner particles, the central diameter (median diameter) of the lubricant is 230 nm, and the particle size (median diameter) of the colorant is 150 nm.

Production of toner 13:

By following the same procedure as in the production of toner 1 except that in the production of toner 1, the resin fine particle dispersion 4 is used, the addition amount of the lubricant dispersion 1 is changed to 7.0% by weight in terms of solid content, and addition amount of the colorant dispersion 1 is changed to 5.0% by weight in terms of solid content, the aggregation temperature is changed to 56° C., and the pH in the inside of the system when the temperature reaches 97° C. after stopping the aggregation is adjusted to 5.2, toner 13 is obtained.

The cumulative volume mean particle size $D_{50}$ of the toner is 6.0 μm and the volume mean particle size distribution index GSDV is 1.24. Also, the ratio of the volume mean particle size distribution index GSDv to the number mean particle size distribution index GSDp is 1.01. Also, the shape factor SF1 is 142 and it is observed that the toner has a potato form. When the cross-section image of the toner is observed by a transmission electron microscope (TEM), the lubricant is dispersed in the toner particles, the central diameter (median diameter) of the lubricant is 240 nm, and the particle size (median diameter) of the colorant is 160 nm.

Production of toner 14:

By following the same procedure as in the production of toner 1 except that in the production of toner 1, the resin fine particle dispersion 5 is used, the addition amount of the lubricant dispersion 1 is changed to 7.0% by weight in terms of solid content, the addition amount of the colorant dispersion 1 is changed to 5.0% by weight in terms of solid content, the aggregation temperature is changed to 50° C., and the pH in the inside of the system when the temperature reaches 97° C. after stopping the aggregation is adjusted to 5.6, toner 14 is obtained.

The cumulative volume mean particle size $D_{50}$ of the toner is 6.1 μm and the volume mean particle size distribution index GSDv is 1.23. Also, the ratio of the volume mean particle size distribution index GSDv to the number mean particle size distribution index GSDp is 1.09. Also, the shape factor SF1 is 145 and it is observed that the toner has an irregular form. When the cross-section image of the toner is observed by a transmission electron microscope (TEM), the lubricant is dispersed in the toner particles, the central diameter (median diameter) of the lubricant is 210 nm, and the particle size (median diameter) of the colorant is 171 nm.

Production of toner 15:

By following the same procedure as in the production of toner 1 except that in the production of toner 1, the resin fine particle dispersion 6 is used, the addition amount of the lubricant dispersion 1 is changed to 7.0% by weight in terms of solid content, the addition amount of the colorant dispersion 1 is changed to 6.0% by weight in terms of solid content, the aggregation temperature is changed to 53° C., and the pH in the inside of the system when the temperature reaches 97° C. after stopping the aggregation is adjusted to 5.8, toner 15 is obtained.

The cumulative volume mean particle size $D_{50}$ of the toner is 5.1 μm and the volume mean particle size distribution index GSDv is 1.21. Also, the ratio of the volume mean particle size distribution index GSDv to the number mean particle size distribution index GSDp is 0.99. Also, the shape factor SF1 is 145 and it is observed that the toner has an irregular form. When the cross-section image of the toner is observed by a transmission electron microscope (TEM), the lubricant is dispersed in the toner particles, the central diameter (median diameter) of the lubricant is 190 nm, and the particle size (median diameter) of the colorant is 159 nm.

Production of toner 16:

By following the same procedure as in the production of toner 1 except that in the production of toner 1, the resin fine particle dispersion 7 is used, the addition amount of the lubricant dispersion 1 is changed to 8.0% by weight in terms of solid content, the aggregation temperature is changed to 60° C., and the pH in the inside of the system when the temperature reaches 97° C. after stopping the aggregation is adjusted to 4.6, toner 16 is obtained.

The cumulative volume mean particle size $D_{50}$ of the toner is 5.7 μm and the volume mean particle size distribution index GSDv is 1.20. Also, the ratio of the volume mean particle size distribution index GSDv to the number mean particle size distribution index GSDp is 1.01. Also, the shape factor SF1 is 111 and it is observed that the toner has a spherical form. When the cross-section image of the toner is observed by a transmission electron microscope (TEM), the lubricant is dispersed in the toner particles, the central diameter (median diameter) of the lubricant is 380 nm, and the particle size (median diameter) of the colorant is 169 nm.

Production of toner 17:

By following the same procedure as in the production of toner 1 except that in the production of toner 1, the resin fine particle dispersion 8 is used, the aggregation temperature is changed to 53° C., the melt.coalescence temperature after stopping the aggregation is changed to 85° C. and the pH in the inside of the system in this case is adjusted to 4.8, toner 17 is obtained.

The cumulative volume mean particle size $D_{50}$ of the toner is 5.6 μm and the volume mean particle size distribution index GSDv is 1.24. Also, the ratio of the volume mean particle size distribution index GSDv to the number mean particle size distribution index GSDp is 1.07. Also, the shape factor SF1 is 138 and it is observed that the toner has a potato form. When the cross-section image of the toner is observed by a transmission electron microscope (TEM), the lubricant is dispersed in the toner particles, the central diameter (median diameter) of the lubricant is 310 nm, and the particle size (median diameter) of the colorant is 168 nm.

Production of toner 18:

By following the same procedure as in the production of toner 1 except that the aggregation is carried out according to the production of toner 1 and when the particle size becomes 4.3 μm, 40 parts by weight of the resin fine particle dispersion is additionally added, toner 18 is obtained.

The cumulative volume mean particle size $D_{50}$ of the toner is 5.2 μm and the volume mean particle size distribution index GSDv is 1.18. Also, the ratio of the volume mean particle size distribution index GSDv to the number mean particle size distribution index GSDp is 1.00. Also, the shape factor SF1 is 116 and it is observed that the toner has a spherical form. When the cross-section image of the toner is observed by a transmission electron microscope (TEM), the lubricant is dispersed in the toner particles, the central diameter (median diameter) of the lubricant is 210 nm, and the particle size (median diameter) of the colorant is 159 nm.

Production of toner 19:

By following the same procedure as in the production of toner 1 except that in the production of toner 1, the resin fine particle dispersion 12 is used, the addition amount of the lubricant dispersion 1 is changed to 7.0% by weight in terms of solid content, the addition amount of the colorant dispersion 1 is changed to 5.0% by weight in terms of solid content, the aggregation temperature is changed to 54° C., and the pH in the inside of the system when the temperature reaches 97° C. after stopping the aggregation is adjusted to 4.8, toner 19 is obtained.

The cumulative volume mean particle size $D_{50}$ of the toner is 5.7 μm and the volume mean particle size distribution index GSDv is 1.21. Also, the ratio of the volume mean particle size distribution index GSDv to the number mean particle size distribution index GSDp is 1.03. Also, the shape factor SF1 is 121 and it is observed that the toner has a spherical form. When the cross-section image of the toner is observed by a transmission electron microscope (TEM), the lubricant is dispersed in the toner particles, the central diameter (median diameter) of the lubricant is 372 nm, and the particle size (median diameter) of the colorant is 186 nm.

Production of toner 20:

By following the same procedure as in the production of the toner 1 except that in the production of the toner 1, the resin fine particle dispersion 9 is used, the aggregation temperature is changed to 54° C., and the pH in the inside of the system when the temperature reaches 97° C. after stopping the aggregation is adjusted to 5.0, toner 20 is obtained.

The cumulative volume mean particle size $D_{50}$ of the toner is 5.0 μm and the volume mean particle size distribution index GSDv is 1.21. Also, the ratio of the volume mean particle size distribution index GSDv to the number mean particle size distribution index GSDp is 1.01. Also, the shape factor SF1 is 143 and it is observed that the toner has a rough potato form. When the cross-section image of the toner is observed by a transmission electron microscope (TEM), the lubricant is dispersed in the toner particles, the central diameter (median diameter) of the lubricant is 420 nm, and the particle size (median diameter) of the colorant is 169 nm.

Production of toner 21:

By following the same procedure as in the production of toner 1 except that in the production of toner 1, the resin fine particle dispersion 10 is used, the aggregation temperature is changed to 51° C., and the pH in the inside of the system when the temperature reaches 97° C. after stopping the aggregation is adjusted to 3.6, toner 21 is obtained.

The cumulative volume mean particle size $D_{50}$ Of the toner is 5.6 μm, the volume mean particle size distribution index GSDv is 1.24, and the ratio of the volume mean particle size distribution index GSDv to the number mean particle size distribution index GSDp is 1.05. Also, the shape factor SF1 is 120 and it is observed that the toner has a spherical form. When the cross-section image of the toner is observed by a transmission electron microscope (TEM), the lubricant is dispersed in the toner particles, the central diameter (median diameter) of the lubricant is 190 nm, and the particle size (median diameter) of the colorant is 131 nm.

Production of toner 22:

By following the same procedure as in the production of toner 1 except that in the production of toner 1, the resin fine particle dispersion 11 is used, the addition amount of the lubricant dispersion 1 is changed to 27.5% by weight in terms of solid content, the aggregation temperature is changed to 63° C., the melt.coalescence time after stopping the aggregation is changed to 8 hours, and the pH in the inside of the system when the temperature reaches 97° C. after stopping the aggregation is adjusted to 6.0, toner 22 is obtained.

The cumulative volume mean particle size $D_{50}$ of the toner is 11.2 μm, the volume mean particle size distribution index GSDv is 1.39, and the ratio of the volume mean particle size distribution index GSDv to the number mean particle size distribution index GSDp is 0.89. Also, the shape factor SF1 is 146 and it is observed that the toner has an irregular type. When the cross-section image of the toner is observed by a transmission electron microscope (TEM), the lubricant is dispersed in the toner particles, the central diameter (median diameter) of the lubricant is 1830 nm, and the particle size (median diameter) of the colorant is 217 nm.

Production of toner 23:

By following the same procedure as in the production of toner 4 except that in the production of toner 1, the addition amount of the lubricant dispersion 1 is changed to 4.0% by weight in terms of solid content, and the pH in the inside of the system when the temperature reaches 97° C. is adjusted to 8.0, toner 23 is obtained.

The cumulative volume mean particle size $D_{50}$ of the toner is 6.1 μm, the volume mean particle size distribution index GSDV is 1.21, and the ratio of the volume mean particle size distribution index GSDv to the number mean particle size distribution index GSDp is 0.89. Also, the shape factor SF1 is 143 and it is observed that the toner has an irregular type. When the cross-section image of the toner is observed by a transmission electron microscope (TEM), the lubricant is dispersed in the toner particles, the central diameter (median diameter) of the lubricant is 111 nm, and the particle size (median diameter) of the colorant is 370 nm.

Preparation of developer:

To 50 g of each of the toners 1 to 23 is added 1.8 parts by weight of hydrophobic silica (TS 720, made by Cabot Co.) and mixed by a sample mill. The eternally added toner is added to a ferrite carrier which has a mean particle size of 50 $\mu$m and is coated with polymethyl methacrylate at 1% by weight so that the toner concentration becomes 5% by weight, and they are mixed by stirring in a ball mill for 5 minutes to provide each developer.

EXAMPLE 1

About the toner 1, when the temperature dispersion at the dynamic viscoelasticity is measured, crosslinking molecular weight Mc of the toner is $1.83\times10^5$ and the crosslinking density Me thereof is $4.9\times10^{-7}$ $Kmol^{-1}$. When the fixing property of the toner 1 is determined using a modified machine of A Color 635 made by Fuji Xerox Co., Ltd., it is confirmed that the releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner 1 is measured, the charging property shows −27 $\mu$C/g at 23° C., 60% RH (usual environment), −29 $\mu$C/g at 10° C., 30% RH (winter environment), and −25 $\mu$C/g at 28° C., 85% RH (summer environment), and the environmental dependence is not observed.

EXAMPLE 2

About the toner 2, when the temperature dispersion at the dynamic viscoelasticity is measured, the crosslinking molecular weight Mc of the toner is $1.79\times10^5$ and the crosslinking density Me thereof is $4.1\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, and the fixing property of the fixed images to the fixing sheet is determined, the fixing property is good and an image defect of the folded portion is not observed.

Furthermore, when the charging property of the toner is measured, the charging property showed −29 $\mu$C/g at 23° C., 60% RH (usual environment), −33 $\mu$C/g at 10° C., 30% RH (winter environment), and −25 $\mu$C/g at 28° C., 85% RH (summer environment), and the environmental dependence is not observed.

EXAMPLE 3

About the toner 3 described above, when the temperature dispersion at the dynamic viscoelasticity is measured, the crosslinking molecular weight Mc of the toner is $1.62\times10^5$ and the crosslinking density Me thereof is $3.7\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −29 $\mu$C/g at 23° C., 60% RH (usual environment), −31 $\mu$C/g at 10° C., 30% RH (winter environment), and −22 $\mu$C/g at 28° C., 85% RH (summer environment), and the environmental dependence is not observed.

EXAMPLE 4

About the toner 4 described above, when the temperature dispersion at the dynamic viscoelasticity is measured, the crosslinking molecular weight Mc of the toner is $1.61\times10^4$ and the crosslinking density Me thereof is $6.24\times10^{-8}$ $Kmol^{-1}$. When the fixing property of the toner is determined using a modified machine of A Color 635 made by Fuji Xerox Co., Ltd., it is confirmed that the oil-less releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −22 $\mu$C/g at 23° C., 60% RH (usual environment), −25 $\mu$C/g at 10° C., 30% RH (winter environment), and −20 $\mu$C/g at 28° C., 85% RH (summer environment), and the environmental dependence is not observed.

EXAMPLE 5

About the toner 5 described above, when the temperature dispersion at the dynamic viscoelasticity is measured, the crosslinking molecular weight Mc of the toner is $1.97\times10^4$ and the crosslinking density Me thereof is $3.91\times10^{-8}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −31 $\mu$C/g at 23° C., 60% RH (usual environment), −36 $\mu$C/g at 10° C., 30% RH (winter environment), and −26 $\mu$C/g at 28° C., 85% RH (summer environment), and the environmental dependence is not observed.

TABLE 1

| | Example 1 | Example 2 | Example 3 | Example 4 | Example 5 |
|---|---|---|---|---|---|
| Crosslinking molecular wt. Mc | $1.83 \times 10^5$ | $1.79 \times 10^5$ | $1.62 \times 10^5$ | $1.61 \times 10^4$ | $1.97 \times 10^4$ |
| Crosslinking density Me | $4.90 \times 10^{-7}$ | $4.10 \times 10^{-7}$ | $3.70 \times 10^{-7}$ | $6.24 \times 10^{-8}$ | $3.91 \times 10^{-8}$ |
| Addition amount of crosslinking agent (wt. %) | 0.64 | 0.64 | 0.64 | 0.17 | 0.17 |
| Tg (° C.) of resin fine particles | 58 | 58 | 58 | 57 | 57 |
| Mw of resin fine particles | 53700 | 53700 | 53700 | 34100 | 34100 |
| GSDv | 1.21 | 1.23 | 1.19 | 1.24 | 1.19 |
| GSDv/GSDp | 1.10 | 1.01 | 0.98 | 1.17 | 1.10 |
| Content (wt. %) of surface lubricant | 8.28 | 10.0 | 15.00 | 8.00 | 10.00 |
| Cent. diam. (nm) of surf. lub. particles | 310 | 390 | 190 | 1120 | 1390 |
| Content (wt. %) of coloring agent | 6.02 | 14.5 | 4.50 | 6.00 | 5.00 |
| Cent. diam. (nm) of coloring agent | 174 | 311 | 214 | 106 | 152 |
| Shape factor SF1 | 114 | 130 | 139 | 122 | 134 |
| Toner mean particle size $D_{50}$ ($\mu$m) | 5.1 | 3.3 | 8.7 | 4.9 | 6.2 |
| Charging amount. ($\mu$C/g) | −27 | −29 | −29 | −22 | −31 |
| Image density | good | good | good | good | good |
| Toner scattering and fog | none | none | none | none | none |
| Offset property | good | good | good | good | good |
| Releasing property of fixing sheet | good | good | good | good | good |
| Surface gloss of fixing sheet | good | good | good | good | good |
| Transparency of OHP sheet | good | good | good | good | good |
| Fixing property to fixing sheet | good | good | good | good | good |
| Bending resistance of fixed image | good | good | good | good | good |

EXAMPLE 6

About the toner 6 described above, when the temperature dispersion at the dynamic viscoelasticity is measured, the crosslinking molecular weight Mc of the toner is $1.97\times10^4$ and the crosslinking density Me thereof is $3.91\times10^{-8}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −34 $\mu$C/g at 23° C., 60% RH (usual environment), −38 $\mu$C/g at 10° C., 30% RH (winter environment), and −27 $\mu$C/g at 28° C., 85% RH (summer environment), and the environmental dependence is not observed.

EXAMPLE 7

About the toner 7 described above, when the temperature dispersion at the dynamic viscoelasticity is measured, the crosslinking molecular weight Mc of the toner is $3.42\times10^4$ and the crosslinking density Me thereof is $3.44\times10^{-6}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −26 $\mu$C/g at 23° C., 60% RH (usual environment), −30 $\mu$C/g at 10° C., 30% RH (winter environment), and −25 $\mu$C/g at 28° C., 85% RH (summer environment), and the environmental dependence is not observed.

EXAMPLE 8

About the toner 8 described above, when the temperature dispersion at the dynamic viscoelasticity is measured, the crosslinking molecular weight Mc of the toner is $1.78\times10^6$ and the crosslinking density Me thereof is $1.61\times10^{-6}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −24 $\mu$C/g at 23° C., 60% RH (usual environment), −25 $\mu$C/g at 10° C., 30% RH (winter environment), and −23 $\mu$C/g at 28° C., 85% RH (summer environment), and the environmental dependence is not observed.

EXAMPLE 9

About the toner 9 described above, when the temperature dispersion at the dynamic viscoelasticity is measured, the crosslinking molecular weight Mc of the toner is $8.91\times10^5$ and the crosslinking density Me thereof is $9.14\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −28 $\mu$C/g at 23° C., 60% RH (usual environment), −30 $\mu$C/g at 10° C., 30% RH (winter environment), and −27 $\mu$C/g at 28° C., 85% RH (summer environment), and the environmental dependence is not observed.

EXAMPLE 10

About the toner 10 described above, when the temperature dispersion at the dynamic viscoelasticity is measured, the crosslinking molecular weight Mc of the toner is $2.79\times10^5$ and the crosslinking density Me thereof is $5.61\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −27 μC/g at 23° C., 60% RH (usual environment), −27 μC/g at 10° C., 30% RH (winter environment), and −26 μC/g at 28° C., 85% RH (summer environment), and the environmental dependence is not observed.

TABLE 2

| | Example 6 | Example 7 | Example 8 | Example 9 | Example 10 |
|---|---|---|---|---|---|
| Crosslinking molecular wt. Mc | $1.97\times10^4$ | $3.42\times10^6$ | $1.78\times10^6$ | $8.91\times10^5$ | $2.79\times10^5$ |
| Crosslinking density Me | $3.91\times10^{-8}$ | $3.44\times10^{-6}$ | $1.61\times10^{-6}$ | $9.14\times10^{-7}$ | $5.61\times10^{-7}$ |
| Addition amount of crosslinking agent (wt. %) | 0.17 | 2.13 | 2.13 | 2.13 | 0.64 |
| Tg (° C.) of resin fine particles | 57 | 51 | 51 | 51 | 58 |
| Mw of resin fine particles | 34100 | 79300 | 79300 | 79300 | 53700 |
| GSDv | 1.25 | 1.23 | 1.22 | 1.24 | 1.19 |
| GSDv/GSDp | 1.10 | 0.97 | 1.14 | 1.11 | 1.07 |
| Content (wt. %) of surface lubricant | 15.00 | 5.00 | 7.00 | 9.00 | 8.00 |
| Cent. diam. (nm) of surf. lub. particles | 1440 | 290 | 320 | 840 | 220 |
| Content (wt. %) of coloring agent | 5.00 | 14.50 | 4.00 | 5.00 | 7.50 |
| Cent. diam. (nm) of coloring agent | 322 | 220 | 117 | 206 | 132 |
| Shape factor SF1 | 137 | 136 | 127 | 118 | 128 |
| Toner mean particle size $D_{50}$ (μm) | 6.5 | 3.4 | 8.9 | 6.6 | 5.3 |
| Charging amount. (μC/g) | −34 | −26 | −24 | −28 | −27 |
| Image density | good | good | good | good | good |
| Toner scattering and fog | none | none | none | none | none |
| Offset property | good | good | good | good | good |
| Releasing property of fixing sheet | good | good | good | good | good |
| Surface gloss of fixing sheet | good | good | good | good | good |
| Transparency of OHP sheet | good | good | good | good | good |
| Fixing property to fixing sheet | good | good | good | good | good |
| Bending resistance of fixed image | good | good | good | good | good |

EXAMPLE 11

About the toner 11 described above, when the temperature dispersion at the dynamic viscoelasticity is measured, the crosslinking molecular weight Mc of the toner is $1.91\times10^5$ and the crosslinking density Me thereof is $4.22\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −29 μC/g at 23° C., 60% RH (usual environment), −30 μC/g at 10° C., 30% RH (winter environment), and −27 μC/g at 28° C., 85% RH (summer environment), and the environmental dependence is not observed.

EXAMPLE 12

About the toner 12 described above, when the temperature dispersion at the dynamic viscoelasticity is measured, the crosslinking molecular weight Mc of the toner is $1.94\times10^5$ and the crosslinking density Me thereof is $4.71\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −26 μC/g at 23° C., 60% RH (usual environment), −29 μC/g at 10° C., 30% RH (winter environment), and −24 μC/g at 28° C., 85% RH (summer environment), and the environmental dependence is not observed.

EXAMPLE 13

About the toner 13 described above, when the temperature dispersion at the dynamic viscoelasticity is measured, the crosslinking molecular weight Mc of the toner is $9.18\times10^5$ and the crosslinking density Me thereof is $3.19\times10^{-6}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −28 μ/g at 23° C., 60% RH (usual environment), −30 μC/g at 10° C., 30% RH (winter environment), and −28 μC/g at 28° C., 85% RH (summer environment), and the environmental dependence is not observed.

EXAMPLE 14

About the toner 14 described above, when the temperature dispersion at the dynamic viscoelasticity is measured, the crosslinking molecular weight Mc of the toner is $1.71\times10^{4}$ and the crosslinking density Me thereof is $1.67\times10^{-8}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −29 μC/g at 23° C., 60% RH (usual environment), −30 μC/g at 10° C., 30% RH (winter environment), and −27 μC/g at 28° C., 85% RH (summer environment), and the environmental dependence is not observed.

EXAMPLE 15

About the toner 15 described above, when the temperature dispersion at the dynamic viscoelasticity is measured, the crosslinking molecular weight Mc of the toner is $3.10\times10^{5}$ and the crosslinking density Me thereof is $4.41\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −29 μC/g at 23° C., 60% RH (usual environment), −34 μC/g at 10° C., 30% RH (winter environment), and −28 μC/g at 28° C., 85% RH (summer environment), and the environmental dependence is not observed.

TABLE 3

| | Example 11 | Example 12 | Example 13 | Example 14 | Example 15 |
|---|---|---|---|---|---|
| Crosslinking molecular wt. Mc | $1.91\times10^{5}$ | $1.94\times10^{5}$ | $9.18\times10^{5}$ | $1.71\times10^{4}$ | $3.10\times10^{5}$ |
| Crosslinking density Me | $4.22\times10^{-7}$ | $4.71\times10^{-7}$ | $3.19\times10^{-6}$ | $1.67\times10^{-8}$ | $4.41\times10^{-7}$ |

TABLE 3-continued

| | Example 11 | Example 12 | Example 13 | Example 14 | Example 15 |
|---|---|---|---|---|---|
| Addition amount of crosslinking agent (wt. %) | 0.64 | 0.64 | 0.65 | 0.65 | 0.65 |
| Tg (° C.) of resin fine particles | 58 | 58 | 58 | 53 | 55 |
| Mw of resin fine particles | 53700 | 53700 | 37600 | 64500 | 59300 |
| GSDv | 1.21 | 1.20 | 1.24 | 1.23 | 1.21 |
| GSDv/GSDp | 1.11 | 1.06 | 1.01 | 1.09 | 0.99 |
| Content (wt. %) of surface lubricant | 8.00 | 8.00 | 7.00 | 7.00 | 7.00 |
| Cent. diam. (nm) of surf. lub. particles | 210 | 230 | 240 | 210 | 190 |
| Content (wt. %) of coloring agent | 10.00 | 6.00 | 7.00 | 5.00 | 6.00 |
| Cent. diam. (nm) of coloring agent | 130 | 150 | 160 | 171 | 159 |
| Shape factor SF1 | 130 | 130 | 142 | 145 | 145 |
| Toner mean particle size $D_{50}$ (μm) | 5.1 | 5.2 | 6.0 | 6.1 | 5.1 |
| Charging amount. (μC/g) | −29 | −26 | −28 | −29 | −29 |
| Image density | good | good | good | good | good |
| Toner scattering and fog | none | none | none | none | none |
| Offset property | good | good | good | good | good |
| Releasing property of fixing sheet | good | good | good | good | good |
| Surface gloss of fixing sheet | good | good | good | good | good |
| Transparency of OHP sheet | good | good | good | good | good |
| Fixing property to fixing sheet | good | good | good | good | good |
| Bending resistance of fixed image | good | good | good | good | good |

EXAMPLE 16

About the toner 16 described above, when the temperature dispersion at the dynamic viscoelasticity is measured, the crosslinking molecular weight Mc of the toner is $3.49\times10^{5}$ and the crosslinking density Me thereof is $4.72\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −25 μC/g at 23° C., 60% RH (usual environment), −26 μC/g at 10° C., 30% RH (winter environment), and −23 PC/g at 28° C., 85% RH (summer environment), and the environmental dependence is not observed.

EXAMPLE 17

About the toner 17 described above, when the temperature dispersion at the dynamic viscoelasticity is measured, the crosslinking molecular weight Mc of the toner is $5.91\times10^{5}$ and the crosslinking density Me thereof is $5.11\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −36 μC/g at 23° C., 60% RH (usual environment), −39 μC/g at 10° C., 30% RH (winter environment), and −35 μC/g at 28° C., 85% RH (summer environment), and the environmental dependence is not observed.

EXAMPLE 18

About the toner 18 described above, when the temperature dispersion at the dynamic viscoelasticity is measured, the crosslinking molecular weight Mc of the toner is $2.01\times10^5$ and the crosslinking density Me thereof is $5.01\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −21 μC/g at 23° C., 60% RH (usual environment), −23 μC/g at 10° C., 30% RH (winter environment), and −20 μC/g at 28° C., 85% RH (summer environment), and the environmental dependence is not observed.

EXAMPLE 19

About the toner 19 described above, when the temperature dispersion at the dynamic viscoelasticity is measured, the crosslinking molecular weight Mc of the toner is $1.91\times10^5$ and the crosslinking density Me thereof is $6.11\times10^{-7}$ $Kmol^{-1}$. When the fixing property of the toner is determined using a modified machine of A Color 635 made by Fuji Xerox Co., Ltd., it is confirmed that the oilless releasing property by a PFA tube roller and the offset property are good, and a fixing sheet is released without any resistance. Also, the surface gloss of the fixing sheet is good. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property shows −28 μC/g at 23° C., 60% RH (usual environment), −30 μC/g at 10° C., 30% RH (winter environment), and −25 μC/g at 28° C., 85% RH (summer environment), and the environmental dependence is not observed.

TABLE 4

| | Example 16 | Example 17 | Example 18 | Example 19 |
|---|---|---|---|---|
| Crosslinking molecular wt. Mc | $3.49\times10^5$ | $5.91\times10^5$ | $2.01\times10^5$ | $1.91\times10^5$ |
| Crosslinking density Me | $4.72\times10^{-7}$ | $5.11\times10^{-7}$ | $5.01\times10^{-7}$ | $6.11\times10^{-7}$ |
| Addition amount of crosslinking agent (wt. %) | 0.65 | 0.65 | 0.64 | 0 |
| Tg (° C.) of resin fine particles | 62 | 55 | 58 | 56 |
| Mw of resin fine particles | 61900 | 74300 | 53700 | 27300 |
| GSDv | 1.20 | 1.24 | 1.18 | 1.21 |
| GSDv/GSDp | 1.01 | 1.07 | 1.00 | 1.03 |
| Content (wt. %) of surface lubricant | 8.00 | 8.28 | 8.28 | 7.00 |
| Cent. diam. (nm) of surf. lub. particles | 380 | 310 | 210 | 372 |
| Content (wt. %) of coloring agent | 6.02 | 6.02 | 6.02 | 6.02 |
| Cent. diam. (nm) of coloring agent | 169 | 168 | 159 | 186 |
| Shape factor SF1 | 111 | 138 | 116 | 121 |
| Toner mean particle size $D_{50}$ (μm) | 5.7 | 5.6 | 5.2 | 5.7 |
| Charging amount. (μC/g) | −25 | −36 | −21 | −28 |
| Image density | good | good | good | good |
| Toner scattering and fog | none | none | none | none |
| Offset property | good | good | good | good |
| Releasing property of fixing sheet | good | good | good | good |
| Surface gloss of fixing sheet | good | good | good | good |
| Transparency of OHP sheet | good | good | good | good |
| Fixing property to fixing sheet | good | good | good | good |
| Bending resistance of fixed image | good | good | good | good |

COMPARATIVE EXAMPLE 1

About the toner 20 described above, when the temperature dispersion at the dynamic viscoelasticity is measured, a gentle flat region is slightly observed, the crosslinking molecular weight Mc of the toner is $1.02\times10^3$ and the crosslinking density Me thereof is $7.14\times10^{-9}$ $Kmol^{-1}$. When the fixing property of the toner is determined using a modified machine of A Color 635 made by Fuji Xerox Co., Ltd., it is confirmed that the oilless releasing property by a PFA tube roller and the offset property are slightly inferior, and the occurrence of HOT (hot offset) at a fixing temperature of 180° C. is observed. Also, the releasing property of a fixing sheet is bad a little and waving is seen at the delivery of the sheet. The surface gloss is loared a little. The transparency of an OHP sheet is good and a transparent image having no turbidity is confirmed. A fixing sheet having fixed images is two-folded, the folded portion is strongly scratched with nails, and when the fixing sheet is opened again, the fixing property of the fixed images to the fixing sheet is good and an image defect of the folded portion is not observed.

Furthermore, when the charging property of the toner is measured, the charging property is good, showing −28 μC/g at 23° C., 60% RH (usual environment).

COMPARATIVE EXAMPLE 2

About the toner 21 described above, when the temperature dispersion at the dynamic viscoelasticity is measured, a clear flat region is observed on the toner, the crosslinking molecular weight Mc of the toner is $5.11\times10^{3}$, and the crosslinking density Me thereof is $5.91\times10^{-5}$ $Kmol^{-1}$. When the fixing property of the toner is determined using a modified machine of A Color 635 made by Fuji Xerox Co., Ltd., it is confirmed that in the oilless releasing property by a PFA tube roller and in the offset property, HOT and inferior releasing are not observed. However, the surface gloss of the fixing sheet is low, and white turbidity is observed in an OHP sheet. And a fixing sheet having fixed images is two-folded, the folded portion is strongly scratched with nails, and when the fixing sheet is opened again, and the fixing property of the fixed images to the fixing sheet in this case is determined, the fixing property is low and severe image defects are observed at the folded portion.

Furthermore, when the charging property of the toner is measured, the charging property shows a low value as −18 μC/g at 23° C., 60% RH (usual environment).

COMPARATIVE EXAMPLE 3

About the toner 22 described above, when the temperature dispersion at the dynamic viscoelasticity is measured, a clear flat region is observed on the toner, the crosslinking molecular weight Mc of the toner is $4.51\times10^{6}$, and the crosslinking density Me thereof is $5.13\times10^{-5}$ $Kmol^{-1}$. When the fixing property of the toner is determined using a modified machine of A Color 635 made by Fuji Xerox Co., Ltd., in the oilless releasing property by a PFA tube roller and in the offset property, good releasing property is observed but a cold offset is seen. The surface gloss of the fixing sheet is low, and white turbidity is observed in an OHP sheet. Also, a fixing sheet having fixed images is two-folded, the folded portion is strongly scratched with nails, and when the fixing sheet is opened again and the fixing property of the fixed images to the fixing sheet in this case is determined, the fixing property is low and image defects are observed at the folded portion.

Furthermore, when the charging property of the toner is measured, the charging property shows a high value as −45 μC/g at 23° C., 60% RH (usual environment)

COMPARATIVE EXAMPLE 4

About the toner 23 described above, when the temperature dispersion at the dynamic viscoelasticity is measured, a clear flat region is observed on the toner, the crosslinking molecular weight Mc of the toner is $5.14\times10^{6}$, and the crosslinking density Me thereof is $6.37\times10^{-7}$ $Kmol^{-1}$. When the fixing property of the toner is determined using a modified machine of A Color 635 made by Fuji Xerox Co., Ltd., about the oilless releasing property by a PFA tube roller and the offset property, good releasing property is confirmed but the surface gloss of the fixing sheet is low. About the transparency of an OHP sheet, it is observed that the transparent image becomes blackish. And a fixing sheet having fixed images is two-folded, the folded portion is strongly scratched with nails, and when the fixing sheet is opened again and the fixing property of the fixed images to the fixing sheet in this case is determined, the fixing property is low and image defects are observed at the folded portion.

Furthermore, when the charging property of the toner is measured, the charging property shows a good value as −28 μC/g at 23° C., 60% RH (usual environment)

TABLE 5

| | Comparative Example 1 | Comparative Example 2 | Comparative Example 3 | Comparative Example 4 |
|---|---|---|---|---|
| Crosslinking molecular wt. Mc | $1.02\times10^{3}$ | $5.11\times10^{3}$ | $4.51\times10^{6}$ | $5.14\times10^{6}$ |
| Crosslinking density Me | $7.14\times10^{-9}$ | $5.91\times10^{-5}$ | $5.13\times10^{-5}$ | $6.37\times10^{-5}$ |
| Addition amount of crosslinking agent (wt. %) | 0.05 | 1.65 | 0.65 | 0.64 |
| Tg (° C.) of resin fine particles | 56 | 53 | 59 | 58 |
| Mw of resin fine particles | 41100 | 83500 | 73600 | 53700 |
| GSDv | 1.21 | 1.24 | 1.39 | 1.21 |
| GSDv/GSDp | 1.01 | 1.05 | 1.89 | 0.89 |
| Content (wt. %) of surface lubricant | 8.28 | 8.28 | 8.28 | 4.00 |
| Cent. diam. (nm) of surf. lub. particles | 420 | 190 | 1830 | 111 |
| Content (wt. %) of coloring agent | 6.02 | 6.02 | 6.02 | 6.00 |
| Cent. diam. (nm) of coloring agent | 169 | 131 | 217 | 370 |
| Shape factor SF1 | 143 | 120 | 146 | 143 |
| Toner mean particle size $D_{50}$ (μm) | 5.0 | 5.6 | 11.2 | 6.1 |
| Charging amount. (μC/g) | −28 | −18 | −45 | −28 |
| Image density | good | good | low | good |
| Toner scattering and fog | none | seen | seen | none |
| Offset property | hot offset | good | cold offset | good |
| Releasing property of fixing sheet | slightly inferior | good | good | good |
| Surface gloss of fixing sheet | slightly low | low | low | low |

TABLE 5-continued

| | Comparative Example 1 | Comparative Example 2 | Comparative Example 3 | Comparative Example 4 |
|---|---|---|---|---|
| Transparency of OHP sheet | good | white turbid | white turbid | blackish |
| Fixing property to fixing sheet | good | low | weak | low |
| Bending resistance of fixed image | good | severe defects | image defects | image defects |

As described above, according to the present invention, by employing the above-described construction, it becomes possible to provide an electrostatic-charged developer toner having a high oilless fixing property as a PFA tube roller, having a large HOT resistance, having a good bending resistance of fixed images, and having excellent charging property and charging stability.

What is claimed is:

1. An electrostatic-charged image developing toner comprising a binder resin and a colorant, wherein a crosslinking molecular weight Mc obtained by a temperature dispersion measurement in the dynamic viscoelasticity of the toner is from about $1.6\times10^4$ to $3.5\times10^6$.

2. The electrostatic-charged image developing toner according to claim 1 wherein a crosslinking density Me obtained by a temperature dispersion measurement in the dynamic viscoelasticity of the toner is from about $1.6\times10^{-8}$ to $3.5\times10^{-6}$/Kmol.

3. The electrostatic-charged image developing toner according to claim 1 wherein the binder resin containing a crosslinking agent represented by following formula:

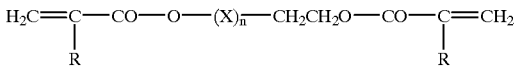

wherein x represents $CH_2$ or $CH_2CH_2O$, n represents an integer of from 4 to 14, and R represents a hydrogen atom or $CH_3$.

4. The electrostatic-charged image developing toner according to claim 3 wherein the addition amount of the crosslinking agent is in the range of from about 0.1 to 1.5% by weight based on the binder resin.

5. The electrostatic-charged image developing toner according to claim 1 wherein the glass transition temperature (Tg) of the toner is in the range of from about 50 to 65° C.

6. The electrostatic-charged image developing toner according to claim 1 wherein a volume mean particle size distribution index GSDv of the toner is not more than about 1.30 and the ratio of the GSDv to a number mean particle size index GSDp is at least about 0.95.

7. The electrostatic-charged image developing toner according to claim 1 wherein the toner contains a lubricant and the content of the lubricant is in the range of from about 5 to 25% by weight.

8. The electrostatic-charged image developing toner according to claim 7 wherein the central diameter of the lubricant dispersed in the toner is in the range of from about 150 to 1500 nm as measured by a transmission electron microscope (TEM).

9. The electrostatic-charged image developing toner according to claim 1 wherein the content of the colorant in the toner is in the range of from about 4 to 15% by weight.

10. The electrostatic-charged image developing toner according to claim 1 wherein the central diameter of the colorant particles dispersed in the toner is in the range of from about 100 to 330 nm as measured by a transmission electron microscope (TEM).

11. The electrostatic-charged image developing toner according to claim 1 wherein the shape factor SF1 of the toner is in the range of from about 110 to 145.

12. The electrostatic-charged image developing toner according to claim 1 wherein a cumulative volume mean particle size $D_{50}$ of the toner is in the range of from about 3 to 9 $\mu$m.

13. The electrostatic-charged image developing toner according to claim 1 wherein the absolute value of the electrostatically charging amount of the toner is in the range of from about 20 to 40 $\mu$C/g.

14. A method of producing the electrostatic-charged image developing toner, comprising a step of mixing a resin fine particle dispersion having dispersed therein resin fine particles having a particle size of not more than about 1 $\mu$m, a colorant dispersion, and a lubricant dispersion to prepare a dispersion of aggregated particles containing the resin fine particles and the colorant and a step of heating the dispersion of the aggregated particles at a temperature of at least the glass transition point of the resin fine particles to melt.coalesce the aggregated particles, wherein, in the preparation step of the aggregated particles, at least one kind of a polymer of a metal salt is used, and said toner is described in claim 1.

15. The method of producing the electrostatic-charged image developing toner according to claim 14 wherein, after the preparation step of the dispersion of the aggregated particles, a sticking step of sticking the resin fine particles to the aggregated particles by adding the dispersion of the aggregated particles to the dispersion of the resin fine particles and mixing them to form stuck particles is provided and thereafter the step of melt.coalescencing the stuck particles is provided.

16. The method of producing the electrostatic-charged image developing toner according to claim 14 wherein, in the preparation step of the aggregated particles, a polymer of a metal salt is used.

17. The method of producing the electrostatic-charged image developing toner according to claim 16 wherein, as the polymer of the metal salt, a polymer of an inorganic metal salt of tetravalent aluminum is used.

18. An electrostatic-charged image developer comprising a carrier and a toner, wherein the toner is described in claim 1.

19. An image-forming process comprising a step of forming a latent electrostatic image on an electrostatic-charged image holder, a step of forming a toner image by developing the latent electrostatic image with a developer on a developer holder, a step of transferring the toner image on a transfer material, a step of transferring the toner image on the transfer material onto a transfer sheet, and a step of heat-fixing the transferred toner image, wherein, as the developer, the electrostatic-charged image developer described in claim 18 is used.

20. The image-forming process according to claim 19 wherein a step of recovering excessive toner at the formation of the toner image and a recycling step of returning the recovered toner in the recovering step onto the developer holder is provided.

* * * * *